US010391384B2

(12) United States Patent
Powell et al.

(10) Patent No.: US 10,391,384 B2
(45) Date of Patent: Aug. 27, 2019

(54) SKATEBOARD TRUCK

(71) Applicant: Skate One Corp., Goleta, CA (US)

(72) Inventors: George A. Powell, Goleta, CA (US); Michael T. Mete, Santa Barbara, CA (US)

(73) Assignee: SKATE ONE CORP, Goleta, CA (US)

( * ) Notice: Subject to any disclaimer, the term of this patent is extended or adjusted under 35 U.S.C. 154(b) by 8 days.

(21) Appl. No.: 15/341,868

(22) Filed: Nov. 2, 2016

(65) Prior Publication Data

US 2017/0203193 A1 Jul. 20, 2017

Related U.S. Application Data

(60) Provisional application No. 62/249,662, filed on Nov. 2, 2015.

(51) Int. Cl.
*A63C 17/00* (2006.01)
*A63C 17/01* (2006.01)

(52) U.S. Cl.
CPC ..... *A63C 17/012* (2013.01); *A63C 17/0093* (2013.01); *A63C 17/015* (2013.01)

(58) Field of Classification Search
USPC ..... 280/124.103, 87.042
See application file for complete search history.

(56) References Cited

U.S. PATENT DOCUMENTS

| | | | | |
|---|---|---|---|---|
| 296,358 | A | 4/1884 | Rowlett | |
| 313,744 | A | 3/1885 | Lawless | |
| 321,337 | A | 6/1885 | Becktel | |
| 322,383 | A | 7/1885 | Kitselman | |
| 322,504 | A | 7/1885 | Thompson | |
| 324,376 | A | 8/1885 | Hart | |
| 327,222 | A | 9/1885 | Belknap et al. | |
| 328,070 | A | 10/1885 | Rowlett | |
| 5,263,725 | A | 11/1993 | Gesmer et al. | |
| 6,981,710 | B2 | 1/2006 | Cheng | |
| 8,246,058 | B2 | 8/2012 | Wang et al. | |
| 8,328,206 | B2 | 12/2012 | Williams, Jr. | |
| 8,550,473 | B2 | 10/2013 | Miller | |
| 8,556,275 | B1 | 10/2013 | Miller | |
| 8,857,824 | B2 | 10/2014 | Miller | |
| 8,973,923 | B2 | 3/2015 | Miller | |
| 9,095,765 | B2 | 8/2015 | Miller | |
| 2015/0190703 | A1* | 7/2015 | Braden | A63C 17/012 280/124.103 |

* cited by examiner

*Primary Examiner* — Paul N Dickson
*Assistant Examiner* — Hilary L Johns
(74) *Attorney, Agent, or Firm* — Cooley LLP

(57) ABSTRACT

A truck includes a base plate, a hanger, a kingpin, and a bushing assembly. The base plate includes a coupling portion and a contact portion. The kingpin is disposed within a portion of the hanger to rotatably couple the hanger to the base plate. The bushing assembly includes at least one bushing disposed in a recess of the contact portion and in contact with the hanger. The bushing assembly including a bushing adjustment coupled to at least one of the base plate or the hanger and configured to selectively engage the at least one bushing to transition the bushing assembly between a first configuration in which the at least one bushing exerts a first force in response to rotation of the hanger and a second configuration in which the at least one bushing exerts a second force different from the first force in response to rotation of the hanger.

19 Claims, 31 Drawing Sheets

SKATEBOARD TRUCK

CROSS-REFERENCE TO RELATED APPLICATIONS

This application claims priority to and the benefit of U.S. Provisional Patent Application Ser. No. 62/249,662 entitled, "Skateboard Truck," filed Nov. 2, 2015, the disclosure of which is incorporated herein by reference in its entirety.

BACKGROUND

The embodiments described herein relate generally to the trucks of a skateboard, and more particularly, to a skateboard truck with improved ride characteristics and control thereof.

Skateboards are a known means of activity and transportation. Skateboards generally include a deck, a pair of trucks, and a set of bearings and wheels. In some instances, a skateboard can be designed to have a particular set of riding characteristics, designed for a particular riding style, and/or designed for other predetermined functions. For example, a longboard is commonly used as a means of transportation or for "cruising" due at least in part to the fluidity of motion. In some instances, the arrangement of the trucks and/or the manner in which the trucks are mounted to the deck can similarly result in differences in ride characteristics. For example, in some instances, trucks can be mounted to the bottom surface of a deck and can be configured so that wheels to spin freely without contacting the bottom surface of the deck. In other instances, trucks can be coupled to the top surface of a deck and can be configured to "drop through" an opening in the deck. In some instances, such "top-mounted" trucks, for example, can have a lower center of gravity relative to "bottom-mounted" trucks, which can result in different ride characteristics. While the design of some known trucks can be associated with a particular set of riding characteristic, riders may have or may develop personal preferences in ride characteristics. Some known trucks, however, are limited in an amount of adjustment in the truck's ride characteristics available to a user.

Thus, a need exists for improved devices and methods for adjusting the ride characteristics of a truck (e.g., a skateboard truck).

SUMMARY

Devices and methods for adjusting the ride characteristics of a truck (e.g., a skateboard truck) are described herein. In some embodiments, a truck includes a base plate, a hanger, a kingpin, and a bushing assembly. The base plate includes a coupling portion coupled to the kingpin and a contact portion. The hanger is rotatably disposed about a portion the kingpin to rotatably couple the hanger to the base plate. The bushing assembly includes at least one bushing disposed in a recess of the contact portion and in contact with the hanger and a bushing adjustment coupled to at least one of the base plate or the hanger. The bushing adjustment is configured to selectively engage the at least one bushing to transition the bushing assembly between a first configuration in which the at least one bushing exerts a first force in response to rotation of the hanger and a second configuration in which the at least one bushing exerts a second force different from the first force in response to rotation of the hanger.

DETAILED DESCRIPTION

Figure 1:
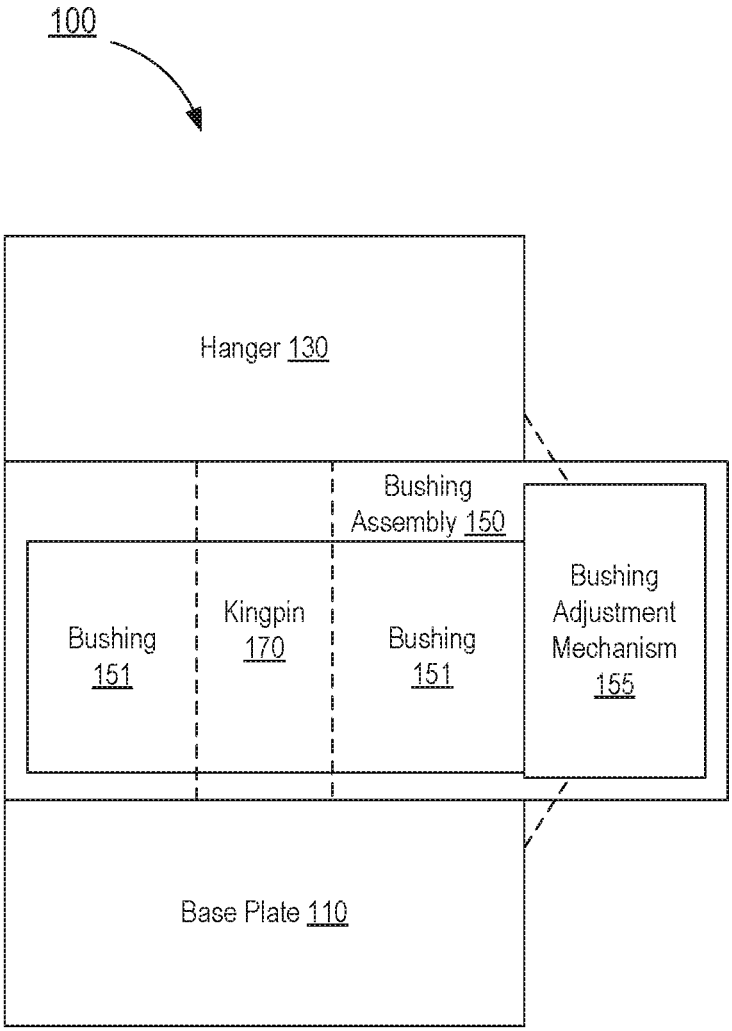
FIG. 1 is a schematic illustration of a truck according to an embodiment.

In some embodiments, a truck includes a base plate, a hanger, a kingpin, and a bushing assembly. The base plate includes a coupling portion coupled to the kingpin and a contact portion. The hanger is rotatably disposed about a portion the kingpin to rotatably couple the hanger to the base plate. The bushing assembly includes at least one bushing disposed in a recess of the contact portion and in contact with the hanger and a bushing adjustment coupled to at least one of the base plate or the hanger. The bushing adjustment is configured to selectively engage the at least one bushing to transition the bushing assembly between a first configuration in which the at least one bushing exerts a first force in response to rotation of the hanger and a second configuration in which the at least one bushing exerts a second force different from the first force in response to rotation of the hanger.

As used in this specification, the singular forms "a," "an" and "the" include plural referents unless the context clearly dictates otherwise. Thus, for example, the term "a member" is intended to mean a single member or a combination of members, "a material" is intended to mean one or more materials, or a combination thereof.

As used herein, the term "set" can refer to multiple features or a singular feature with multiple parts. For example, when referring to a set of walls, the set of walls can be considered as one wall with multiple portions, or the set of walls can be considered as multiple, distinct walls. Thus, a monolithically constructed item can include a set of walls. Such a set of walls may include multiple portions that are either continuous or discontinuous from each other. A set of walls can also be fabricated from multiple items that are produced separately and are later joined together (e.g., via a weld, an adhesive, or any suitable method).

As used herein, the term "perpendicular" generally describes a relationship between two geometric constructions (e.g., two lines, two planes, a line and a plane, or the like) in which the two geometric constructions are disposed at substantially 90°. For example, a line is said to be perpendicular to another line when the lines intersect at an angle substantially equal to 90°. Similarly, when a planar surface (e.g., a two dimensional surface) is said to be perpendicular to another planar surface, the planar surfaces are disposed at substantially 90° as the planar surfaces extend to infinity.

In general, known trucks often include a hanger that is pivotably coupled to a base plate via, for example, a kingpin. To control and/or adjust a pivoting motion of the hanger relative to the base plate, such trucks include at least one bushing that is disposed about the kingpin and in contact with at least a surface of the hanger. In this manner, loading of the at least one bushing (e.g., exerting a compression and/or otherwise increasing an internal stress within the at least one bushing) results in the bushing limiting the pivoting motion of the hanger relative to the base. Thus, increasing or decreasing a force (load) applied to the at least one bushing allows a user to control some of the ride and/or turning characteristics of the truck. The control of these characteristics in such trucks, however, is limited.

The embodiments described herein relate to trucks (e.g., skateboard trucks, roller skate trucks, etc.) with improved ride and/or turning characteristics. As described in further detail herein, the trucks can include a hanger that is disposed about a kingpin, which in turn, is coupled to a base plate. Such an arrangement allows, inter alia, a rotational relationship and/or coupling of the hanger to the base plate rather than a pivoting relationship and/or coupling to the base plate. That is to say, the embodiments described herein include a kingpin that is coupled to the base and that defines a longitudinal axis about which the hanger rotates. Moreover, the embodiments described herein include bushing assemblies that control the rotation of the hanger about the kingpin without disposing one or more bushings 151 about the kingpin.

FIG. 1 is a schematic illustration of a truck 100 according to an embodiment. The truck 100 can be any suitable truck 100 configured to be used with and/or otherwise coupled to a skateboard, roller skate, or the like. In some embodiments, for example, the truck 100 can be a bottom-mounted skateboard truck. That is to say, in such embodiments, a surface of the truck 100 can be placed in contact with a bottom surface of a skateboard deck (not shown in FIG. 1). In other embodiments, the truck 100 can be a top-mounted or drop-through skateboard truck in which a surface of the truck is in contact with a top surface of a skateboard deck. Moreover, the truck 100 can be coupled to any suitable skateboard (e.g., a longboard, street board, downhill board, etc.).

The truck 100 includes a base plate 110, a hanger 130, a bushing assembly 150, and a kingpin 170. As described in further detail herein with respect to specific embodiments, the base plate 110 is configured to be coupled to a skateboard deck or the like to couple the truck 100 thereto. The base plate 110 can be any suitable shape, size, and/or configuration. For example, in some embodiments, the base plate 110 can include a coupling portion or the like configured to engage, contact, and/or couple to the hanger 130, the bushing assembly 150, and/or the kingpin 170.

The kingpin 170 can be any suitable pin, bolt, or fastener operable in movably coupling and/or rotatably coupling the hanger 130 to the base plate 110. For example, in some embodiments, the kingpin 170 is a bolt or the like that is coupled to the base plate 110 and that is maintained in a substantially fixed position relative to the base plate 110 (e.g., via a mechanical fastener such as a nut). Moreover, a portion of the kingpin 170 is rotatably disposed within a portion of the hanger 130 and thus, when the kingpin 170 is coupled to the base plate 110, the hanger 130 is rotatably coupled to the base plate 110. In some embodiments, the kingpin 170 can be substantially similar to conventional kingpins used in, for example, bottom-surface mounted trucks, and thus, is not described in further detail herein.

Although not shown in FIG. 1, in some embodiments, the kingpin 170 can be included in a kingpin assembly or the like. In such embodiments, for example, a kingpin assembly can include a kingpin (such as the kingpin 170), at least one bearing, and a damper. The bearing can be, for example, a pin bearing, a ball bearing, and/or the like. The bearing can be disposed about a portion of the kingpin and can be configured to be inserted into an opening of the hanger. In such arrangements, the bearing can contact an inner surface of the hanger defining the opening and an outer surface of the portion of the kingpin. Thus, the bearing can be configured to facilitate a rotation of the hanger about the kingpin, as described in further detail herein. The damper can be, for example, an elastomeric member or the like disposed about the kingpin and in contact (at least indirectly) with a portion of the hanger and a portion of the base plate. In such arrangements, the damper can be configured to, inter alia, absorb a force associated with a relative movement between the base plate and the hanger, as described in further detail herein.

The hanger 130 can be any suitable shape, size, and/or configuration. As described above, the hanger 130 is configured to be coupled to the kingpin 170, which in turn, couples the hanger 130 to the base plate 110. More particularly, the hanger 130 is rotatably disposed about the kingpin 170 and, as such, is rotatably coupled to the base plate 110 when the kingpin 170 is coupled thereto. Although not shown in FIG. 1, in some embodiments, a portion of the hanger 130 can be inserted into and/or otherwise coupled to a portion of the base plate 110 or vice versa. As described in further detail herein, the hanger 130 can include a contact portion or surface configured to engage (at least indirectly) a portion of the bushing assembly 150.

The bushing assembly 150 includes at least one bushing 151 and a bushing adjustment mechanism 155. As shown in FIG. 1, the bushing assembly 150 is at least partially disposed between the base plate 110 and the hanger 130. In some embodiments, for example, the bushing assembly 150 can be disposed in a position between the base plate 110 and the hanger 130 such that the bushing(s) 151 is/are in contact with a surface of the base plate 110 and/or a surface of the hanger 130. In some embodiments, the arrangement of the bushing assembly 150 can place the bushing(s) 151 in direct contact with a surface of the base plate 110 and/or a surface of the hanger 130. In other embodiments, the arrangement of the bushing assembly 150 can be such that the bushing(s) 151 is/are indirectly in contact with and/or otherwise operably coupled to the surface of the base plate 110 and/or the surface of the hanger 130. For example, although not shown in FIG. 1, the bushing(s) 151 can be disposed on and/or otherwise in contact with an intervening structure (e.g., the bushing adjustment mechanism 155), which in turn, is in contact with and/or otherwise operably coupled to the surface of the base plate 110 and/or the surface of the hanger 130. As described in further detail herein, the positioning of at least a portion of the bushing assembly 150 between the base plate 110 and the hanger 130 can be operative in controlling a rotation of the hanger 130 about the kingpin 170 and relative to the base plate 110.

The bushing(s) 151 can be any suitable bushing or the like. For example, in some embodiments, the bushing(s) 151 can be formed from one or more elastomeric materials and can be configured to absorb and/or otherwise elastically deform in response to an applied force. Such elastomeric materials can be and/or can include, for example, nylon, polyester, polyethylene, polyurethane, polycarbonate, rubber, and/or the like, or a combination thereof. In some embodiments, the shape, size, and/or constituent material of the bushing 151 can be associated with a desired amount of deformation in response to a force. For example, forming the bushing 151 from an elastomeric material with a relatively high hardness or durometer can result in an amount of deformation that is less than an amount of deformation of a bushing formed of an elastomeric material with a relatively low hardness or durometer under substantially the same force. As described in further detail herein, the bushing(s) 151 can be configured to exert a reaction force in response to a rotation of the hanger 130 about the kingpin 170 and relative to the base plate 110. In other words, rotation of the hanger 130 can be associated with and/or at least partially dependent on an amount of deformation of the bushing(s) 151.

In some embodiments, the bushing assembly 150 can include a first bushing 151 disposed, for example, on a first side of the kingpin 170 and in contact with a surface of the base plate 110 and a surface of the hanger 130, and a second bushing 151 disposed, for example, on a second side of the kingpin 170 and in contact with a surface of the base plate 110 and a surface of the hanger 130. In this manner, rotation of the hanger 130 about the kingpin 170 (e.g., relative to the base plate 170) in a first direction can, for example, exert a first force on the first bushing 151, while rotation of the hanger 130 about the kingpin 170 in a second direction can, for example, exert a second force on the second bushing 151. In other embodiments, the bushing assembly 150 can include any number of bushings 151. For example, in some embodiments, a bushing assembly can include one bushing with a first portion disposed on a first side of a kingpin and a second portion disposed on a second side of the kingpin. In other embodiments, the bushing assembly 150 can include more than two bushings 151 (e.g., three, four, five, six, or more). As described in further detail herein, the arrangement and/or configuration of the one or more bushings 151 can be operative to controlling a rotation of the hanger 130 about the kingpin 170.

The bushing adjustment mechanism 155 of the bushing assembly 150 can be any suitable configuration and/or can have any suitable arrangement. In some embodiments, the bushing adjustment mechanism 155 is movably and/or adjustably coupled to the base plate 110, the hanger 130, or both the base plate 110 and the hanger 130. As such, the bushing adjustment mechanism 155 can be moved relative to the base plate 110 and/or hanger 130 to selectively engage, adjust, and/or move at least a portion of the bushing 151 relative to the base plate 110 and/or hanger 130.

In some embodiments, for example, the bushing adjustment mechanism 155 can be and/or can include a plate or the like that is coupled to and/or otherwise in contact with the bushing 151 and configured to be moved relative to the base plate 110 and/or the hanger 130 to move the bushing 151 relative to the base plate 110 and/or hanger 130. For example, the bushing adjustment mechanism 155 can be moved in a transverse direction relative to the base plate 110 and/or hanger 130. The bushing 151, in turn, is moved in the transverse direction, for example, from a first position (e.g., an inward position and/or a position otherwise closer to, for example, the kingpin 170) to a second position (e.g., an outward position and/or a position otherwise farther from the kingpin 170).

In other embodiments, the bushing adjustment mechanism 155 can be moved relative to the base plate 110 and/or the hanger 130 to place the bushing 151 in a position farther away from or closer to, for example, the base plate 110, which can, for example, compress or decompress (e.g., load or unload) the bushing 151. More particularly, the bushing 151 can be disposed between the bushing adjustment mechanism 155 and, for example, a surface of the hanger 130 such that movement the bushing adjustment mechanism 155 closer to or away from the base plate 110 increases or decreases a space between the bushing adjustment mechanism 155 and the surface of the hanger 130, which in turn, decreases or increases, respectively, a compressive force exerted on the bushing 151.

In still other embodiments, the bushing adjustment mechanism 155 can include a first member forming a threaded coupling with, for example, the base plate 110 and a second member forming a threaded coupling with the base plate 110. In such embodiments, the first member and the second member can be disposed on opposite sides of the bushing 151 and each can include a surface that is configured to engage an associated portion of the bushing 151. Therefore, the first member and the second member each can be advanced along its associated threads of the base plate 151 such that the surfaces of the first member and the second member exert an opposing force on the bushing 151, which in turn, increases an amount of internal stress within the bushing 151. The increase in the internal stresses within the bushing 151 is operative in decreasing an amount of deformation of the bushing 151 in response to a rotation of the hanger 130 about the kingpin 170 and thus, allows a user to limit and/or otherwise control the rotation of the hanger 130 relative to the base plate 110, as described in further detail herein.

While described as exerting an opposing force on a single bushing, in other embodiments, the bushing adjustment mechanism 155 can include two or more bushings 151 (as described above). In such embodiments, the first member can exert a force on a first side of a first bushing 151 and a portion of the base plate 110 (e.g., a protrusion, rib, wall, and/or other surface) can exert an opposing force on a substantially opposite side of the first bushing 151. Thus, opposing forces exerted on opposite sides of the first bushing 151 increase an internal stress within the first bushing 151 as the first member advances along the threads of the base plate 110. Similarly, the second member can exert a force on a first side of a second bushing 151 and the portion of the base plate 110 can exert an opposing force on a substantially opposite side of the second bushing 151. Therefore, adjusting the position of the first member and the second member relative to the base plate 110 results in a change of internal stress within the first bushing 151 and the second bushing 151, respectively, which in turn, allows a user to limit and/or otherwise control the rotation of the hanger 130 relative to the base plate 110.

FIGS. 2-14 illustrate a truck 200 according to an embodiment. In some embodiments, the truck 200 can be included in, for example, a skateboard, roller skate, and/or the like (not shown). In general, a skateboard, roller skate, etc. will include a pair of the trucks 200 (e.g., a "front" truck and a "rear" truck). The truck 200 shown and described herein with reference to FIGS. 2-14 can be mounted to either end of a skateboard, roller skate, or the like. Therefore, a discussion of the truck 200 applies to a second truck not shown in FIGS. 2-14, each of which can be coupled to, for example, a skateboard deck to collectively form a portion of a skateboard.

Figure 2:
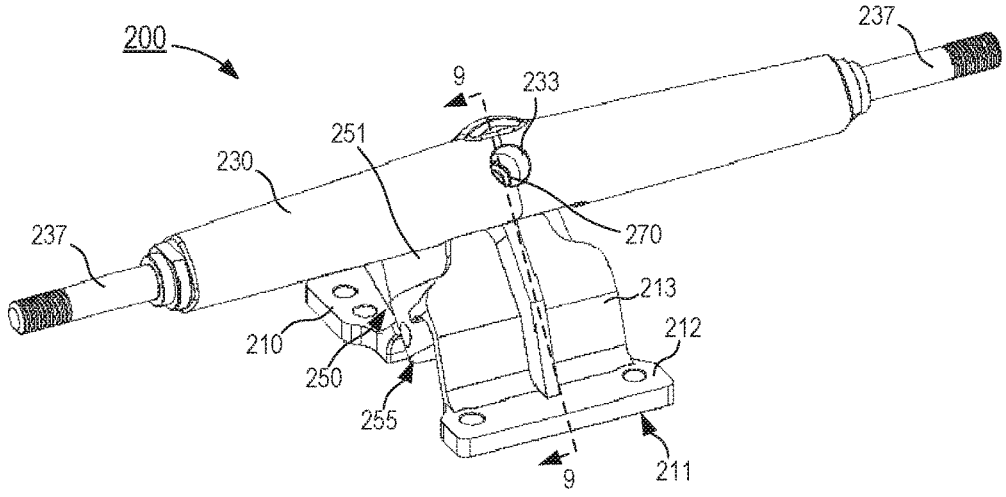
FIG. 2 is a front perspective view of a truck in a first configuration according to an embodiment.
Figure 3:
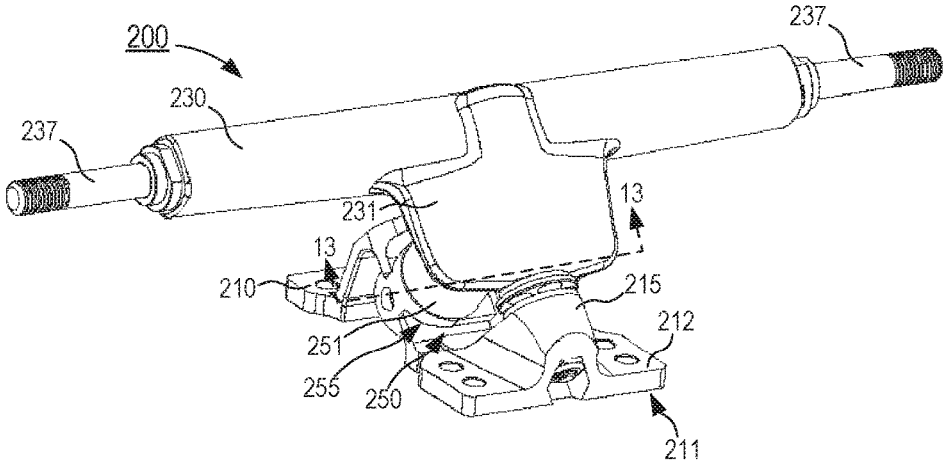
FIG. 3 is a rear perspective view of the truck illustrated in FIG. 2.
Figure 4:
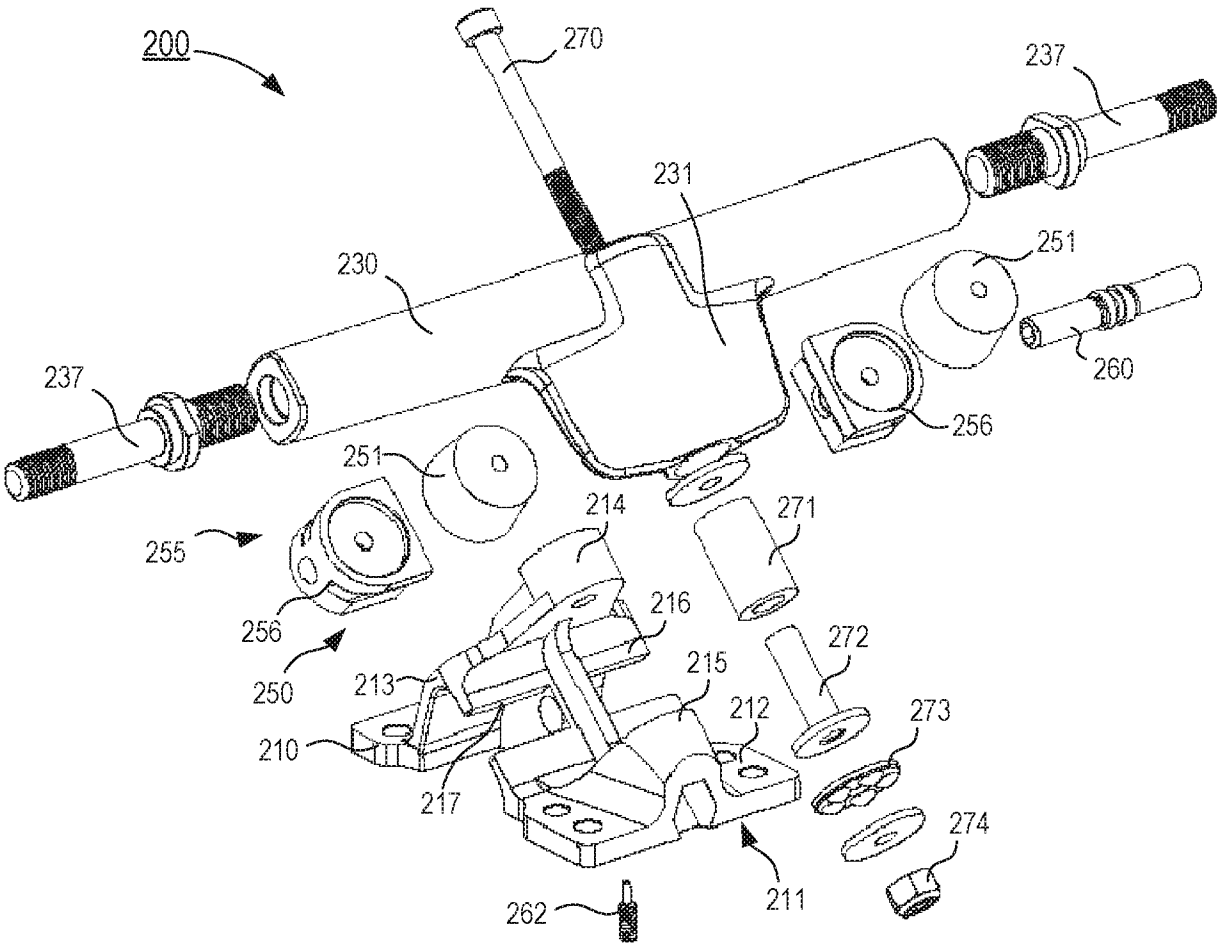
FIG. 4 is an exploded view of the truck illustrated in FIG. 2.

As shown in FIGS. 2 and 3, the truck 200 includes a base plate 210, a hanger 230, a bushing assembly 250, and a kingpin 270. The base plate 210 of the truck 200 can be any suitable shape, size, and/or configuration. As shown in FIGS. 2-6, the base plate 210 has a first surface 211 and a second surface 212 and includes and/or otherwise forms a coupling portion 213. The first surface 211 of the base plate 210 is configured to be mounted, for example, to a bottom surface of a skateboard deck or the like, thereby positioning the hanger 230 beneath the bottom surface of the deck when coupled thereto. The mechanics of coupling the truck 200 to the deck of a skateboard using bolts, screws, etc. can be similar to known bottom-mounted skateboard configurations, and thus, is not described in further detail herein.

Figure 5:
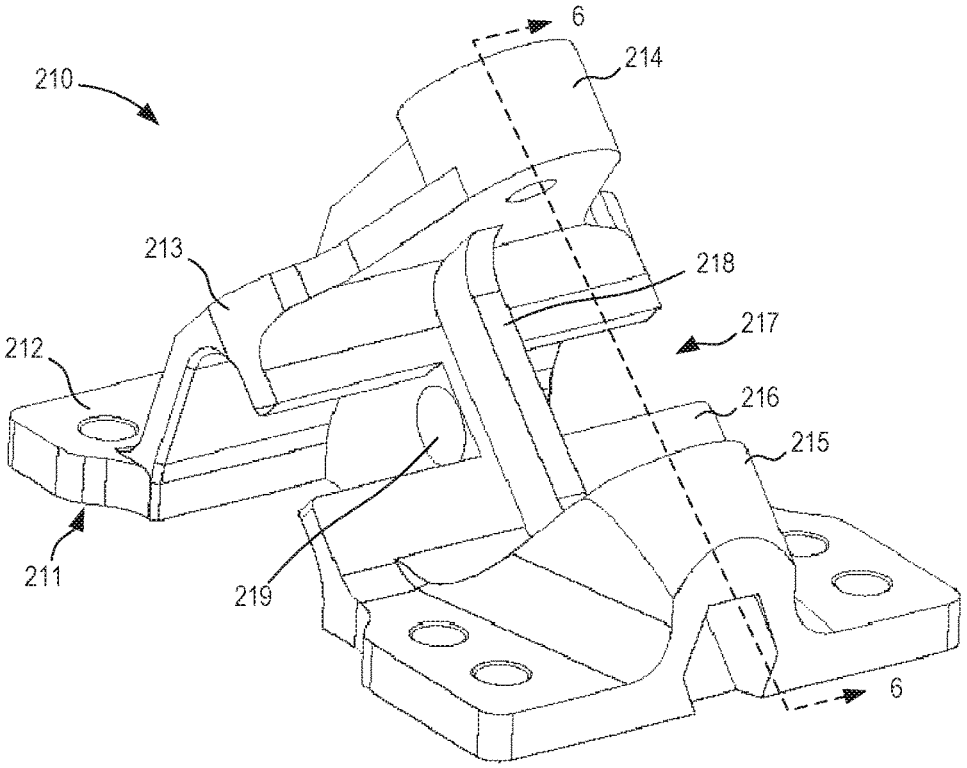
FIG. 5 is a perspective view of a base plate included in the truck of FIG. 2.
Figure 6:
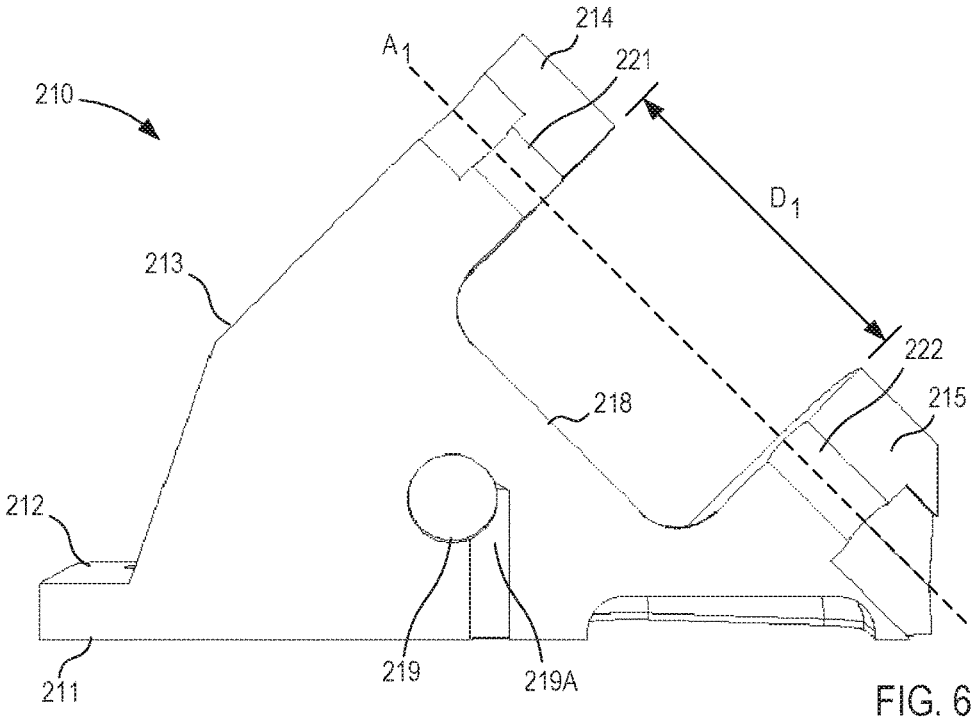
FIG. 6 is a cross-sectional view of the base plate of FIG. 5 taken along the line 6-6.

As shown in FIGS. 5 and 6, the coupling portion 213 of the base plate 210 extends from the second surface 212 of the base plate 210 and includes a first coupler 214 and a second coupler 215. The first coupler 214 and the second coupler 215 each define an opening 221 and 222, respectively, configured to receive a different portion of the kingpin 270 (see e.g., FIG. 12). The arrangement of the first coupler 214 and the second coupler 215 is such that the openings 221 and 222, respectively, collectively define an axis $A_1$ that is disposed at an angle relative to the first surface 211 of the base plate 210, as shown in FIG. 6. For example, in some embodiments, the axis $A_1$ can be disposed at an angle relative to the first surface 211 equal to at about 30°, about 40°, about 45°, about 50°, about 60°, or any other suitable angle or fraction thereof. Moreover, as shown in FIG. 6, the first coupler 214 (or an inner surface thereof) can be disposed at a distance $D_1$ from the second coupler 215 (or an inner surface thereof). The distance $D_1$ can be any suitable distance that is sufficient to receive at least a portion of the hanger 230. In this manner, the first coupler 214 and the second coupler 215 are configured to be at least operably coupled to and/or otherwise configured to engage the kingpin 270 and the hanger 230, as described in further detail herein.

As shown in FIGS. 5 and 6, the coupling portion 213 includes and/or otherwise forms a recessed surface 216 and a rib 218, each of which extend between the first coupler 214 and the second coupler 215 (e.g., extend a distance substantially equal to $D_1$). The rib 218 is substantially centered along a width of the recessed surface 218 and, for example, is configured to provide structural rigidity for the first coupler 214, the second coupler 215, and/or the coupling portion 213. In some embodiments, the rib 218 can be configured to engage a portion of the bushing assembly 250 to control a movement of at least a portion of the bushing assembly 250.

The recessed surface 216 defines a set of transverse slots 217. More particularly, the recessed surface 216 defines a first transverse slot 217 on a first side of the rib 218 and a second transverse slot 217 on a side of the rib 218 opposite the first side. As described in further detail herein, the slots are configured to movably receive a portion of the bushing assembly 250.

As shown in FIG. 5, the base plate 210 defines an opening 219 and a bore 219A. The opening 219 is configured to receive an adjustment pin 260 included in the bushing assembly 250. The bore 219A is configured to receive a setscrew 262 or the like that can be advanced within the bore 219A to be disposed in a desired position relative to the adjustment pin 260, as described in further detail herein.

Figure 7:
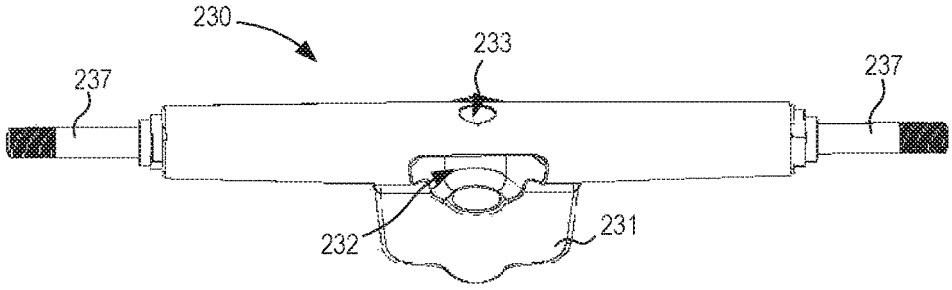
FIG. 7 is a rear view of a hanger included in the truck of FIG. 2.
Figure 8:
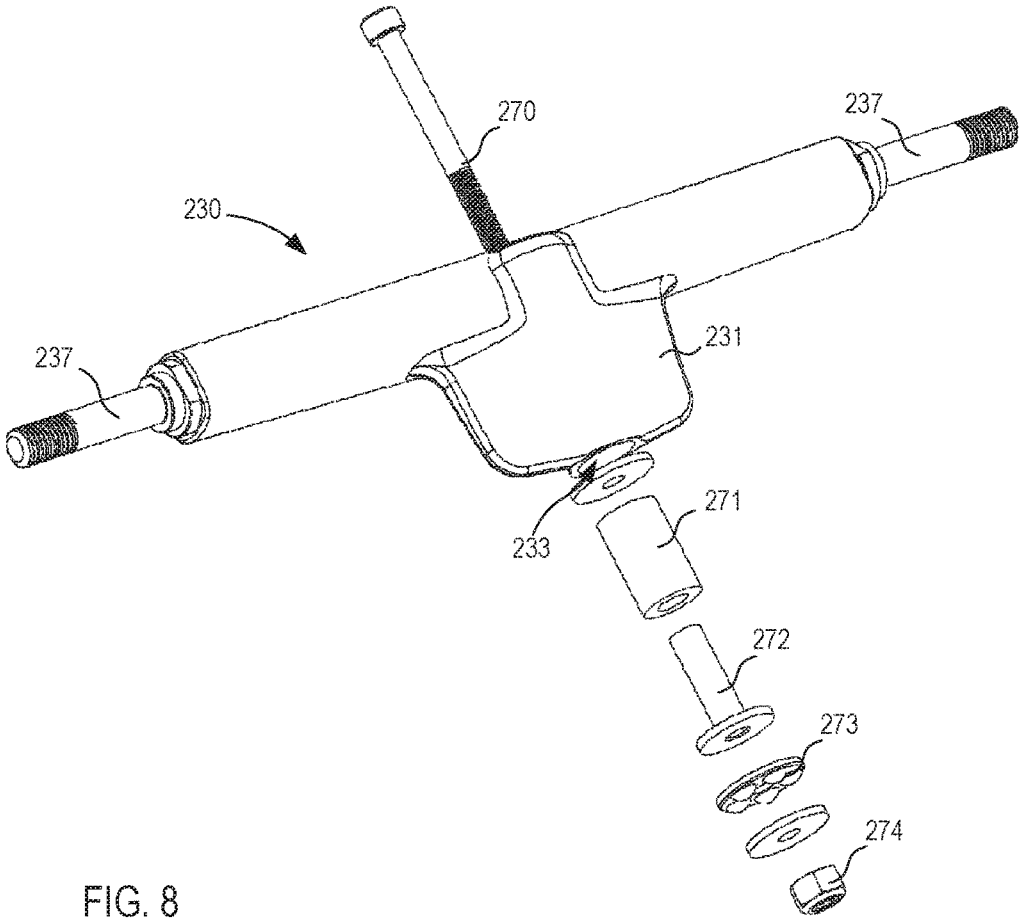
FIG. 8 is an exploded view of a portion of the truck of FIG. 2.
Figure 9:
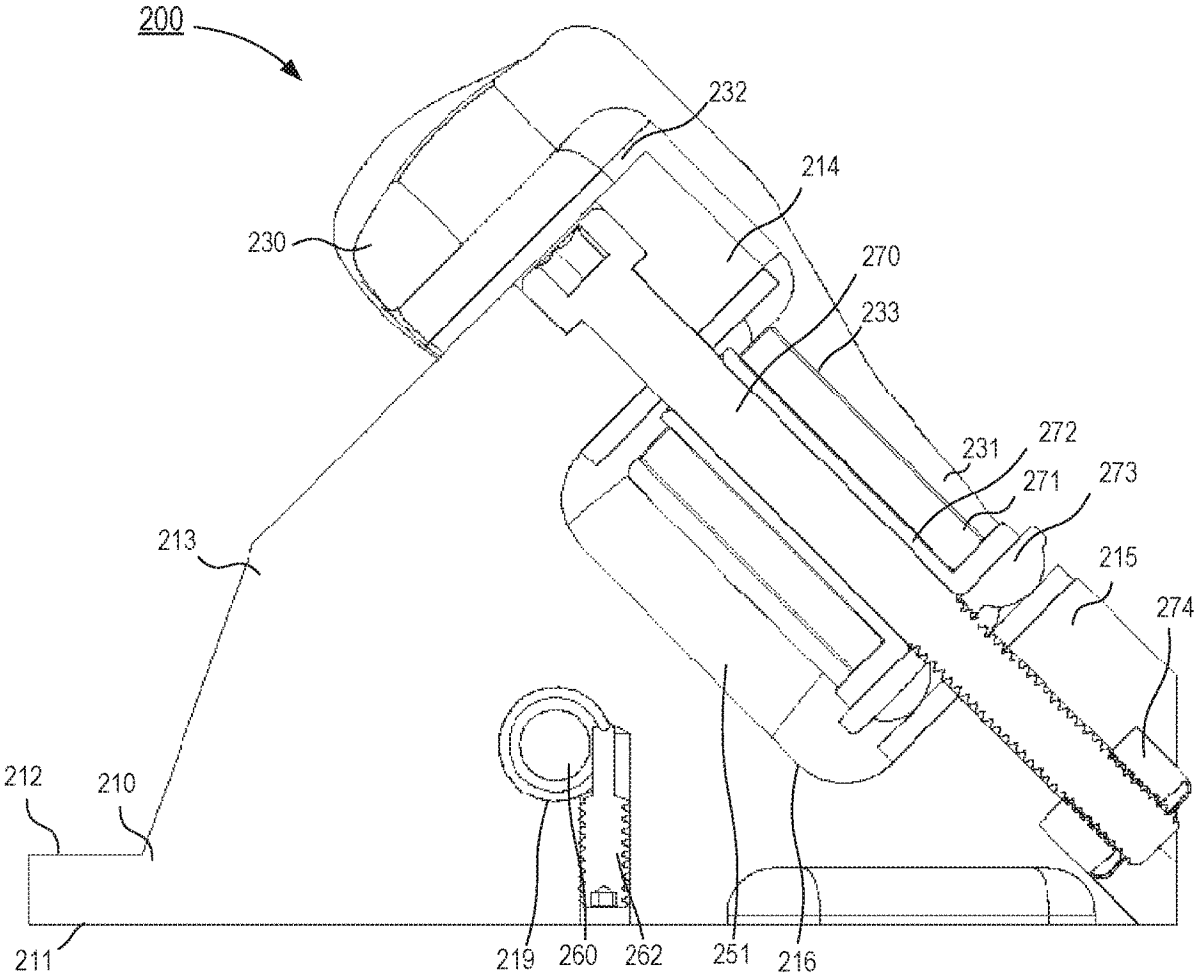
FIG. 9 is a cross-sectional view of the truck of FIG. 2 taken along the line 9-9 in FIG. 2.

The hanger 230 of the truck 200 can be any suitable shape, size, and/or configuration. As shown in FIGS. 7-9, the hanger 230 defines a slot 232 and aperture 233 and includes and/or forms a contact portion 231 and a pair of axles 237. The slot 232 defined by the hanger 230 is configured to receive a portion of the first coupler 214 (see e.g., FIG. 9). The aperture 233 defined by the hanger 230 is configured to receive a portion of the kingpin 270. The contact portion 231 of the hanger 230 can be any suitable configuration. For example, as shown in FIG. 7, the contact portion 231 is a substantially flat flange or the like that extends along a width of the hanger 230. The contact portion 231 is configured to be in contact with a portion of the bushing assembly 250. This arrangement of the hanger 230, base plate 210, kingpin 270 and bushing assembly 250 of the truck 210 is such that the kingpin 270 couples the hanger 230 to the base plate 230 and defines an axis about which the hanger 230 can rotate. Moreover, with the contact portion 231 of the hanger 230 in contact with the portion of the bushing assembly 250, the bushing assembly 250 can be configured to selectively absorb, dampen, and/or otherwise mitigate a force associated with the rotation of the hanger 230 about the kingpin 270, as described in further detail herein.

The axles 237 of the hanger 230 are coupled to opposite lateral sides of the hanger 230 and are each configured to be coupled to and/or otherwise be disposed within an associated wheel (not shown). The coupling of the wheels to the axles 237 can be substantially similar to known methods of coupling wheels to axles and thus, is not described in further detail herein. In this embodiment, each axle 237 is independently coupled to its associated side of the hanger 230. In other words, the axles 237 are independent axles rather than a single continuous axle that extends through the width of the hanger 230. In some embodiments, each axle 237 can be coupled to its associated side via a threaded coupling or the like (see e.g., FIG. 4). In other embodiments, the axles 237 can be an integrated portion of the hanger 230 (e.g., formed via a single casting or the like, over-molded, and/or otherwise fixedly coupled to hanger 230).

In some embodiments, independently coupling (or forming) each axle 237 to its associated side of the hanger 230 rather than including a single or rod extending through the width of the hanger 230, for example, can reduce the weight of the truck 200. In addition, the independent coupling of each axle 237 is such that the slot 232 and the aperture 233 are substantially unobstructed by a portion of an axle that would otherwise be present with a monolithic axle. Thus, the portion of the first coupler 214 of the base plate 210 can be positioned within the slot 232 and the portion of the kingpin 270 can be disposed in the aperture 233 (as described above) without obstruction that would otherwise inhibit the coupling of the hanger 230 to the base plate 210 and/or rotation of the hanger 230 relative to the base plate 210.

The kingpin 270 can be any suitable pin, bolt, or fastener operable in movably coupling the hanger 230 to the base plate 210. For example, in the embodiment illustrated in FIGS. 2-14, the kingpin 270 is a bolt or the like that is configured to engage, receive, and/or couple to a nut 274 to be rigidly coupled to the base plate 210 (see e.g., FIGS. 11 and 12). In some embodiments, the kingpin 270 can be substantially similar to conventional kingpins used in, for example, bottom-surface mounted trucks. Unlike conventional configurations, however, the hanger 230 is disposed about the kingpin 270 via a bearing connection or the like. For example, as shown in FIG. 8, the opening 233 of the hanger 230 is configured to receive an inner sleeve 271 and a bearing 272 (e.g., a pin bearing or the like), which in turn, is configured to receive a portion of the kingpin 270. As such, the hanger 230 can rotate about the axis defined by the kingpin 270. Moreover, by disposing the bearing 272 between the hanger 230 and the kingpin 270, the hanger 230 can rotate about the axis with less friction than arrangements otherwise not including a bearing.

As shown in FIGS. 8 and 9, a damper 273 is configured to be disposed about a portion of the kingpin 270 and between, for example, a surface of the bearing 272 and a surface of the second coupler 215 of the base plate 210 (or a washer in contact therewith). The damper 273 can be configured to dampen and/or otherwise alter forces such as friction forces, axial forces (in the direction of the axis defined by the kingpin 270), and/or the like. For example, in some embodiments, the damper 273 can be configured to limit and/or substantially prevent binding between the bearing 272 and/or hanger 230 and the second coupler 215 of the base plate 210. In other embodiments, the damper 273 can increase a friction force exerted in response to a rotation of the hanger 230 relative to the base plate 210. In this manner, the damper 273 can be configured to tune, adjust, and/or at least partially control one or more characteristics associated with movement of the hanger 230 relative to the base plate 210.

The bushing assembly 250 can be any suitable assembly, mechanism, and/or member configured to selectively engage a portion of the base plate 210 and the hanger 230 to control movement of the hanger 230 relative to the base plate 210. As shown, for example, in FIGS. 10-14, in this embodiment, the bushing assembly 250 includes two bushings 251 and a bushing adjustment mechanism 255. The bushing assembly 250 is at least partially disposed between the base plate 210 and the hanger 230 (see e.g., FIGS. 2 and 3) such that the bushings 251 are in contact with at least the contact portion 231 of the hanger 230 and the bushing adjustment mechanism 255 is in contact with the base plate 210. In other embodiments, the arrangement of the bushing assembly 250 can be such that the bushing adjustment mechanism 255 is contact with a surface of the base plate 210 and/or a surface of the hanger 230. In other embodiments, the arrangement of the bushing assembly 250 can be such that the bushings are in contact with and/or otherwise operably coupled to the surface of the base plate 210 and/or the surface of the hanger 230. As described in further detail herein, the positioning of at least a portion of the bushing assembly 250 between the base plate 210 and the hanger 230 can be operative in controlling a rotation of the hanger 230 about the kingpin 270 and relative to the base plate 210.

As described above, the bushing assembly 250 includes two bushings 251. The arrangement of the bushing assembly 250 is such that a first bushing 251 is disposed on a first side of the kingpin 270 and in contact with the contact portion 231 of the hanger 230, and a second bushing 251 is disposed on a second side of the kingpin 270 and in contact with the contact portion 231 of the hanger 230. In this manner, rotation of the hanger 230 about the kingpin 270 (e.g., relative to the base plate 210) in a first direction can, for example, exert a first force on the first bushing 251, while rotation of the hanger 230 about the kingpin 270 in a second direction can, for example, exert a second force on the second bushing 251, as described in further detail herein.

The bushings 251 can be any suitable bushing or the like. For example, in some embodiments, the bushings 251 can be formed from one or more elastomeric materials and can be configured to absorb and/or otherwise elastically deform in response to an applied force, as described above with reference to the bushings 151 in FIG. 1. As such, the shape, size, and/or constituent material of the bushings 251 can be associated with and/or otherwise selected to produce a desired amount of deformation in response to a force. As described in further detail herein, the bushings 251 can be configured to exert a reaction force in response to a rotation of the hanger 230 about the kingpin 270 and relative to the base plate 210. In other words, rotation of the hanger 230 can be associated with and/or at least partially dependent on an amount of deformation of the bushings 251.

Figure 10:
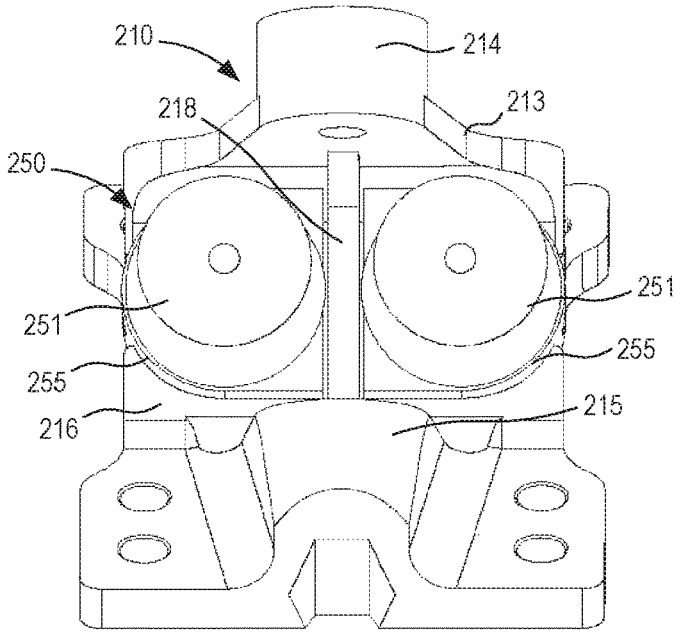
FIG. 10 is a front view of the base plate and a bushing assembly included in the truck of FIG. 2.
Figure 11:
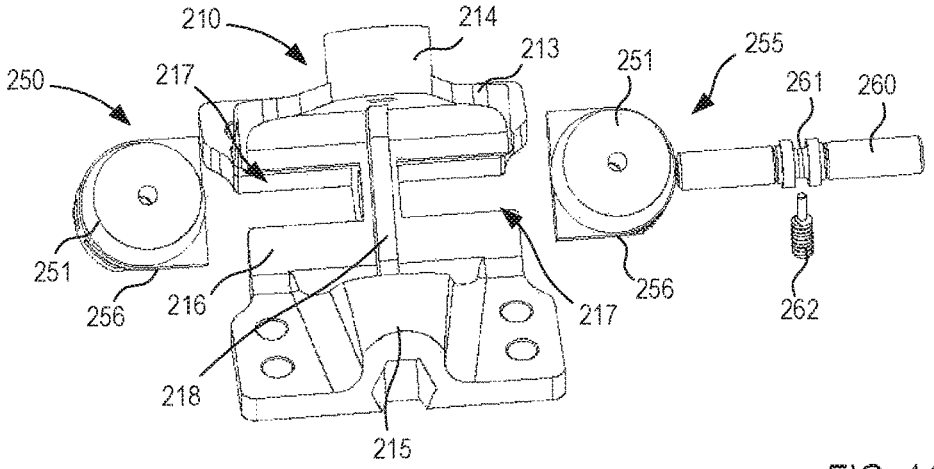
FIG. 11 is a partial exploded view of the base plate and the bushing assembly illustrated in FIG. 10.
Figure 12:
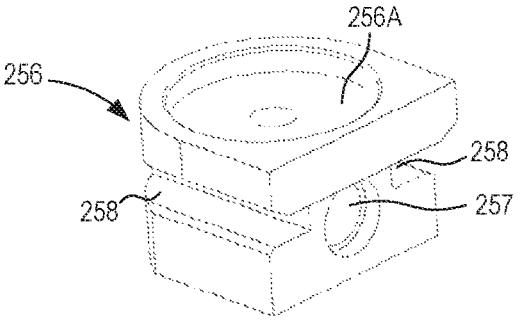
FIG. 12 is a perspective view of a bushing plate included in the bushing assembly of FIG. 11.

The bushing adjustment mechanism 255 of the bushing assembly 250 can be any suitable configuration and/or can have any suitable arrangement. As shown in FIGS. 10-12, the bushing adjustment mechanism 255 includes two bushing plates 256, an adjustment pin 260, and a setscrew 262. Each of the bushing plates 256 includes a recessed surface 256A and defines an opening 257 and a set of channels 258. The recessed surface 256A of each bushing plate 256 is configured to receive and/or otherwise is configured to be coupled to a portion of one of the bushings 251. In some embodiments, the portion of each bushing 251 can form a friction fit with the recessed surface 256A to be coupled to its associated bushing plate 256. In other embodiments, each bushing 251 can be coupled to its associated bushing plate 256 via an adhesive, a mechanical fastener (e.g., a screw), and/or the like.

As shown in FIGS. 10 and 11, the bushing adjustment mechanism 255 is movably and/or adjustably coupled, for example, to the recessed surface 216 of the base plate 210. For example, in this embodiment, each bushing plate 256 is inserted into its associated slot 217 defined by the base plate 210. The arrangement of the bushing plates 256 is such that as each bushing plate 256 is inserted into its associated slot 217, a portion of the recessed surface 217 of the base plate 210 is inserted into the channels 258 defined by that bushing plate 256. As such, the bushing plates 256 can be moved in a transverse direction within the slot 217 between, for example, a first position (e.g., an inward position and/or a position otherwise closer to, for example, the kingpin 270) to a second position (e.g., an outward position and/or a position otherwise farther from the kingpin 270). Moreover, in some embodiments, the rib 218 of the base plate 210 can limit and/or otherwise define a range of inward movement of the bushing plates 256 relative to the base plate 210. Similarly, in some embodiments, the arrangement of the rib 218 can substantially limit an amount of deformation of the bushings 251 in an inward direction (e.g., toward a center of the rib 218). As such, the rib 218 can substantially limit and/or prevent an undesired response of the bushing assembly 250 that would otherwise result from a force associated with the rotation of the hanger 230 about the kingpin 270.

Figure 13:
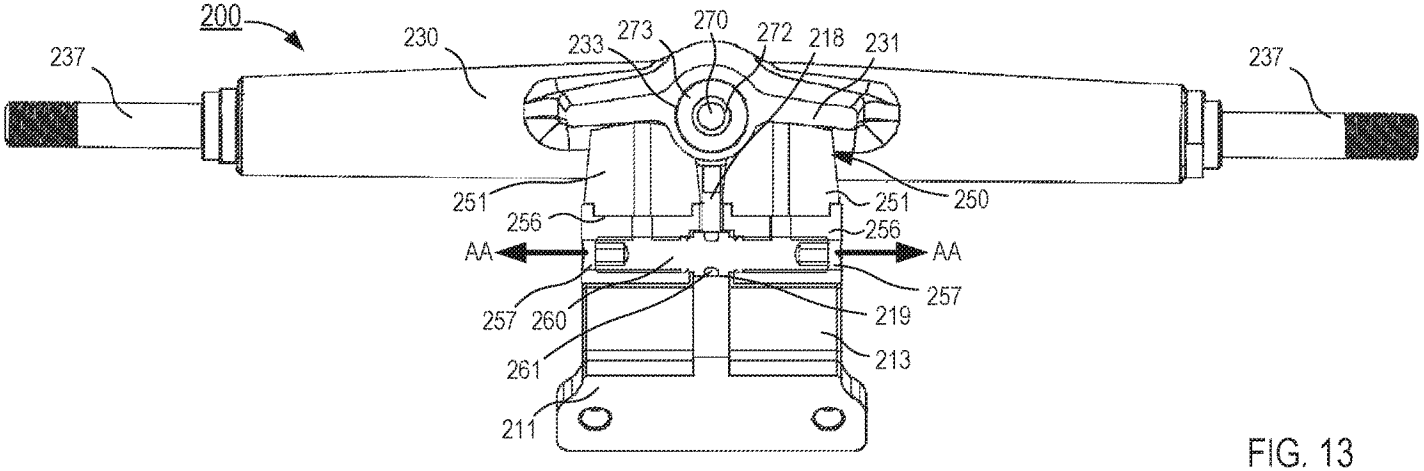
FIG. 13 is a cross-sectional view of the truck of FIG. 2 taken along the line 13-13 in FIG. 3.
Figure 14:
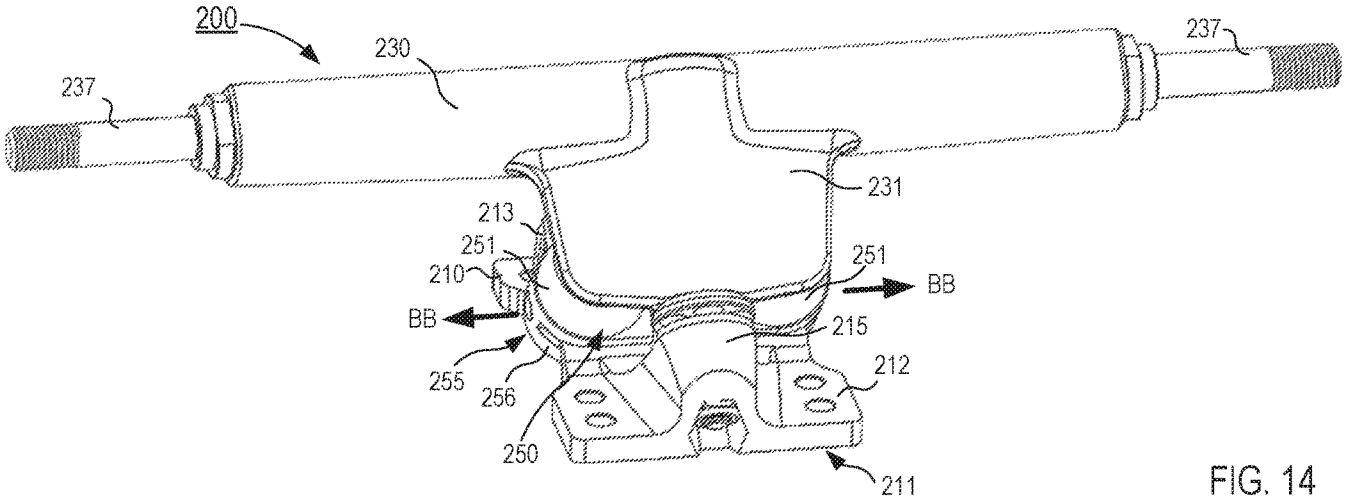
FIG. 14 is a front perspective view of the truck of FIG. 2 in a second configuration.

The adjustment pin 260 of the bushing assembly 250 movably couples the bushing plates 256 to the base plate 210. For example, in this embodiment, the adjustment pin 260 is configured to be inserted into the opening 257 of each bushing plate 256 and the opening 219 of the base plate 210, as shown in FIG. 13. The adjustment pin 260 can be any suitable pin or the like. For example, in some embodiments, the adjustment pin 260 can be an adjustment screw or the like with one or more threaded couplings configured to allow a length of the adjustment screw to be extended. In some embodiments, the adjustment pin 260 can be self-centering such that a length of the adjustment pin 260 is increased by concurrently moving opposite end portions of the adjustment pin 260 away from a center hub or the like of the adjustment pin 260. In other embodiments, the adjustment pin 260 can be any suitable pin, screw, bolt, toggle, pinion, etc. configured to adjustably couple the bushing plates 256 to the base plate 210.

The adjustment pin 260 defines a channel 261 configured to receive a portion of the setscrew 262 (see e.g., FIG. 11). Thus, when a portion of the adjustment pin 260 is disposed in the opening 219 defined by the base plate 210, the setscrew 262 can be positioned within the bore 219A such that at least an end portion of the setscrew 262 is disposed within the channel 261 of the adjustment pin 260 (see e.g., FIG. 9). As such, a first portion of the adjustment pin 260 can be maintained in a substantially fixed position relative to the base plate 210 while a second portion (e.g., one or more adjustment portions) can move relative to the base plate 210, as indicated by the arrow AA in FIG. 13. Although not shown in FIGS. 2-14, the adjustment pin 260 can include any suitable collar, rim, protrusion, and/or the like that can engage a surface of the bushing plates 256 such that adjustment of the adjustment pin 260 (e.g., movement of such adjustment portions) results in movement of the bushing plates 260 relative to the base plate 210. As such, a user can adjust the adjustment pin 260 to move each bushing plate 256 in a transverse direction within and/or along its associated slot 217 defined by the base plate 210, which in turn, moves the bushings 251 in the transverse direction relative, for example, to the contact portion 231 of the hanger 230, as indicated by the arrows BB in FIG. 14.

As described above, the bushings 251 are in contact with the contact portion 231 of the hanger 230 and are configured to exert a reaction force and/or deform in response to a force associated with a rotation of the hanger 230 about the kingpin 270. In some instances, the amount of the reaction force exerted by the bushings 251 and/or the amount of deformation of the bushings 251 can be associated with and/or can be a function of the transverse position of the bushings 251. In other words, the amount of rotation of the hanger 230 about the kingpin 270 can be associated with and/or dependent on the transverse position of the bushings 251.

For example, in use, a user can exert a force on a skateboard deck, roller skate, or the like that is sufficient to rotate the hanger 230 about the kingpin 270. Therefore, when wheels are coupled to the axles 237, the force exerted by the user rotates the hanger 230 about the kingpin 270 with an amount of torque that is dependent on a distance between the point at which the force is applied and the axis about which the hanger 230 rotates. Accordingly, the force exerted on the bushings 251 (as a component of the torque) is similarly dependent on a transverse position of the bushings 251. Thus, the force exerted on the bushings 251 when the bushing assembly 250 is in an inward configuration as shown, for example, in FIG. 13 (e.g., a first configuration) is less than a force exerted on the bushings 251 when the bushing assembly 250 is in an outward configuration as shown, for example, in FIG. 14 (e.g., a second configuration). As a result, when the bushing assembly 250 is in the inward configuration (FIG. 13), the bushings 251 exert a reaction force in response to a first portion of the torque associated with the rotation of the hanger 230 and when the bushing assembly 250 is in the outward configuration (FIG. 14), the bushings 251 exert a reaction force in response to a second portion of the torque that is greater than the first portion of the torque. Said another way, when the bushing assembly 250 is in the inward configuration, the bushings 251 allow the hanger 230 to rotate about the kingpin 270 more than the amount of rotation allowed by the bushings 251 when the bushing assembly 250 is in the outward configuration. Thus, a user can adjust the turning characteristics associated with the truck 200 by moving the bushing plates 256 in the inward or the outward direction relative to the base plate 310.

While the bushing assembly 250 is shown and described above with reference to FIGS. 2-14 as being configured to move the bushings 251 in a transverse direction relative to the base plate 210, in other embodiments, a truck can include a bushing assembly configured to move one or more bushings in any suitable direction. For example, FIGS. 15-22 illustrate a truck 300 according to another embodiment. In some embodiments, the truck 300 can be included in, for example, a skateboard, roller skate, and/or the like (not shown), as described above with reference to the truck 200. Therefore, in use, the truck 300 can be in a "front" position or a "rear" position of a skateboard, roller skate, etc.

Figure 15:
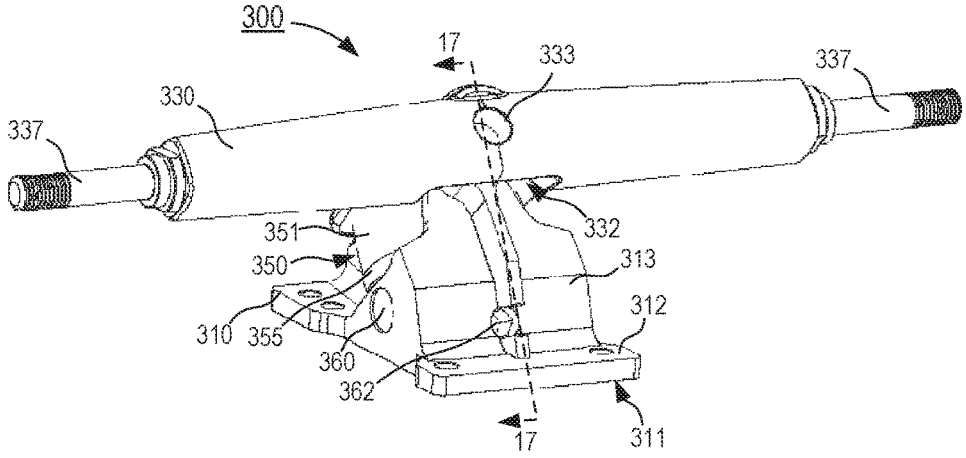
FIG. 15 is a front perspective view of a truck according to another embodiment.
Figure 16:
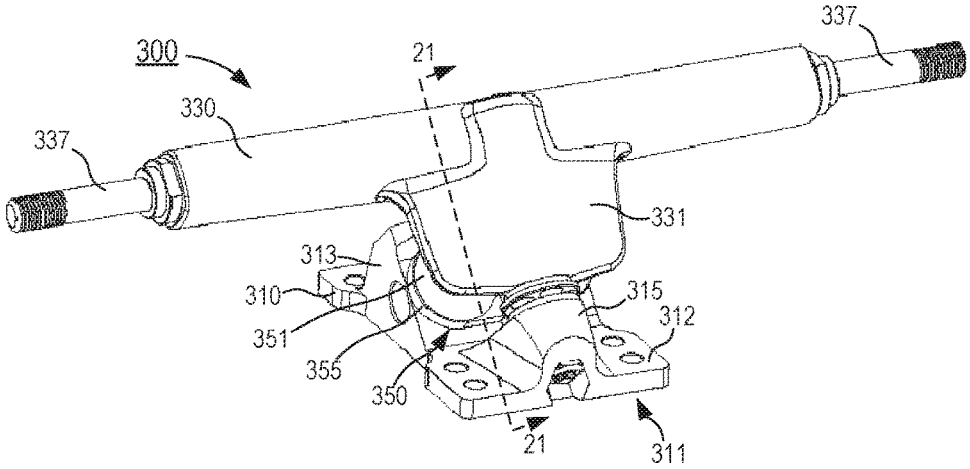
FIG. 16 is a rear perspective view of the truck of FIG. 16.

As shown in FIGS. 15 and 16, the truck 300 includes a base plate 310, a hanger 330, a bushing assembly 350, and a kingpin 370. In some embodiments, portions of the truck 300 can be substantially similar in form and/or function as associated portions of the truck 200 described above with reference to FIGS. 2-14. Thus, such portions of the truck 300 are not described in further detail herein and should be considered substantially the same as the associated portions of the truck 200 unless the context clearly states otherwise.

Figure 17:
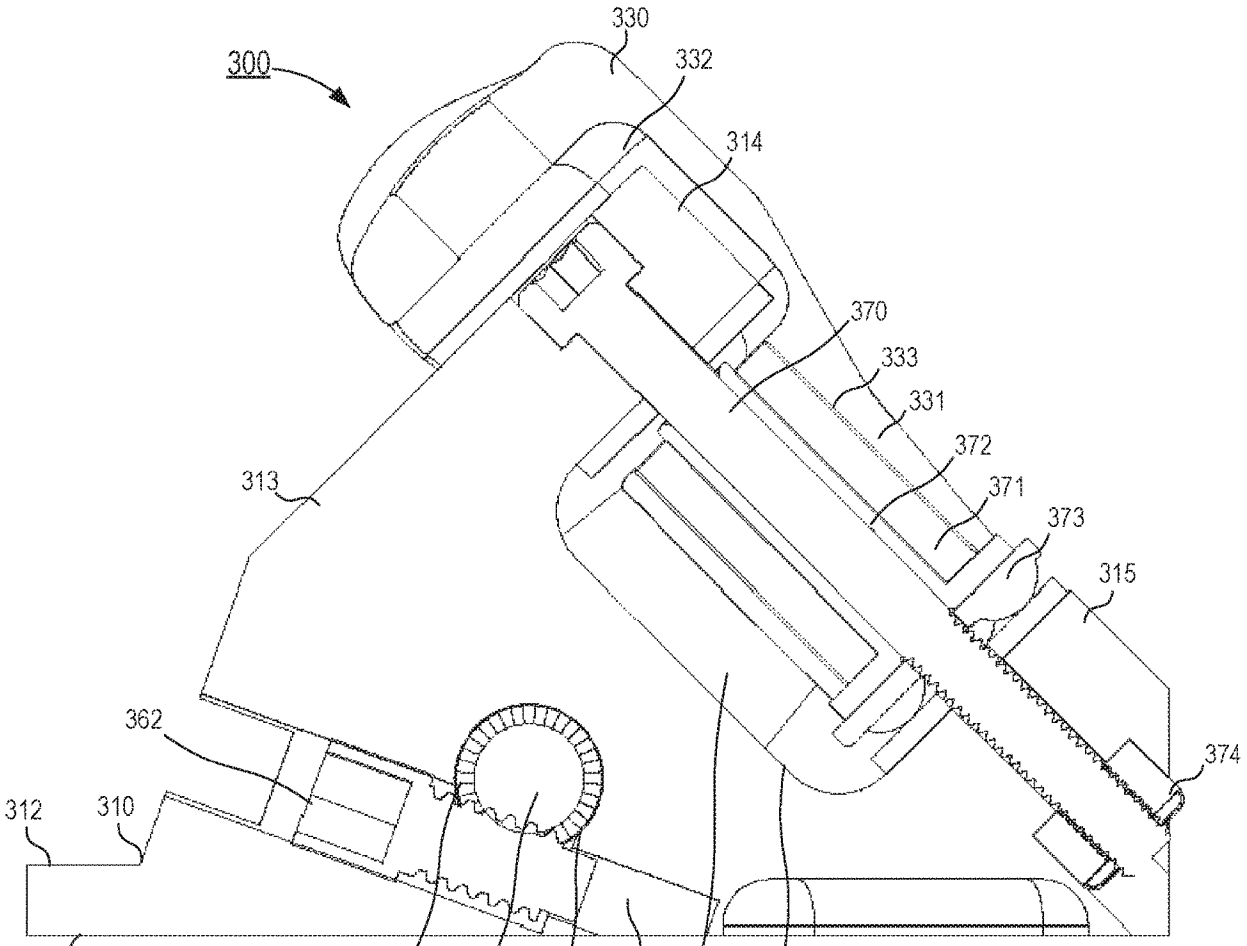
FIG. 17 is a cross-sectional view of the truck of FIG. 15 taken along the line 17-17.

The hanger 330 of the truck 300 is substantially similar to the hanger 230 of the truck 200 described above with reference to FIGS. 7-9 and thus, the hanger 330 is not described in further detail herein. As such, the following description of the hanger 330 is to identify features thereof and is not intended to limit the form and/or function of the hanger 330 unless the context clearly states otherwise. Specifically, as shown in FIGS. 15-17, the hanger 330 defines a slot 332 and aperture 333 and includes and/or forms a contact portion 331 and a pair of axles 337. The slot 332 is configured to receive a first coupler 314 of the base plate 310 (FIG. 17), the aperture 333 is configured to receive a portion of the kingpin 370 (FIG. 17), and the contact portion 331 is configured to be in contact with a portion of the bushing assembly 350 (FIGS. 15-17). The axles 337 of the hanger 330 can each be independently coupled to and/or formed with the hanger 330 such that a single axle does not extend substantially through the width of the hanger 330. Thus, the first coupler 314 can be disposed in the slot 332 and the kingpin 370 can be disposed in the aperture 333.

As described above with reference to the truck 200, the aperture 333 of the hanger 330 is configured to receive the kingpin 370, an inner sleeve 371, and a bearing 372. The arrangement of the portion of the kingpin 370, the inner sleeve 371, and the bearing 372 within the aperture 333 of the hanger 330 is similar to or substantially the same as the arrangement of the kingpin 270, the inner sleeve 271, and the bearing 272 within the aperture 233 of the hanger 230 and thus, is not described in further detail herein. In addition, the truck 300 includes a damper 373 disposed between the bearing 372 and/or the hanger 330 and a second coupler 315 of the base 310, as described above with reference to the damper 273. The damper 373 of the truck 300 is substantially similar in form and function as the damper 273 of the truck 200 and thus, is not described in further detail herein.

The truck 300 can differ from the truck 200 described above with reference to FIGS. 2-14 in the arrangement and/or configuration of at least a portion of the base plate 310 and at least a portion of the bushing assembly 350. For example, the base plate 310 of the truck 300 can be any suitable shape, size, and/or configuration. As shown in FIGS. 15-17, the base plate 310 has a first surface 311 and a second surface 312 and includes and/or otherwise forms a coupling portion 313. The first surface 311 of the base plate 310 is configured to be mounted, for example, to a bottom surface of a skateboard deck or the like, thereby positioning the hanger 330 beneath the bottom surface of the deck when coupled thereto. The mechanics of coupling the truck 300 to the deck of a skateboard using bolts, screws, etc. can be similar to known bottom-mounted skateboard configurations, and thus, is not described in further detail herein.

As shown in FIGS. 15 and 16, the coupling portion 313 of the base plate 310 extends from the second surface 312 of the base plate 310 and includes a first coupler 314, a second coupler 315, and a recessed surface 316, and defines a first bore 319 and a second bore 319A. The first coupler 314 and the second coupler 315 each define an opening 321 and 322, respectively, configured to receive a different portion of the kingpin 370 (see e.g., FIG. 12). In this embodiment, the arrangement and/or function of the first coupler 314 and the second coupler 315 is similar to or substantially the same as the first coupler 214 and the second coupler 215 of the base plate 210 of FIGS. 5 and 6. Thus, the first coupler 314 and the second coupler 315 are not described in further detail herein.

Figure 18:
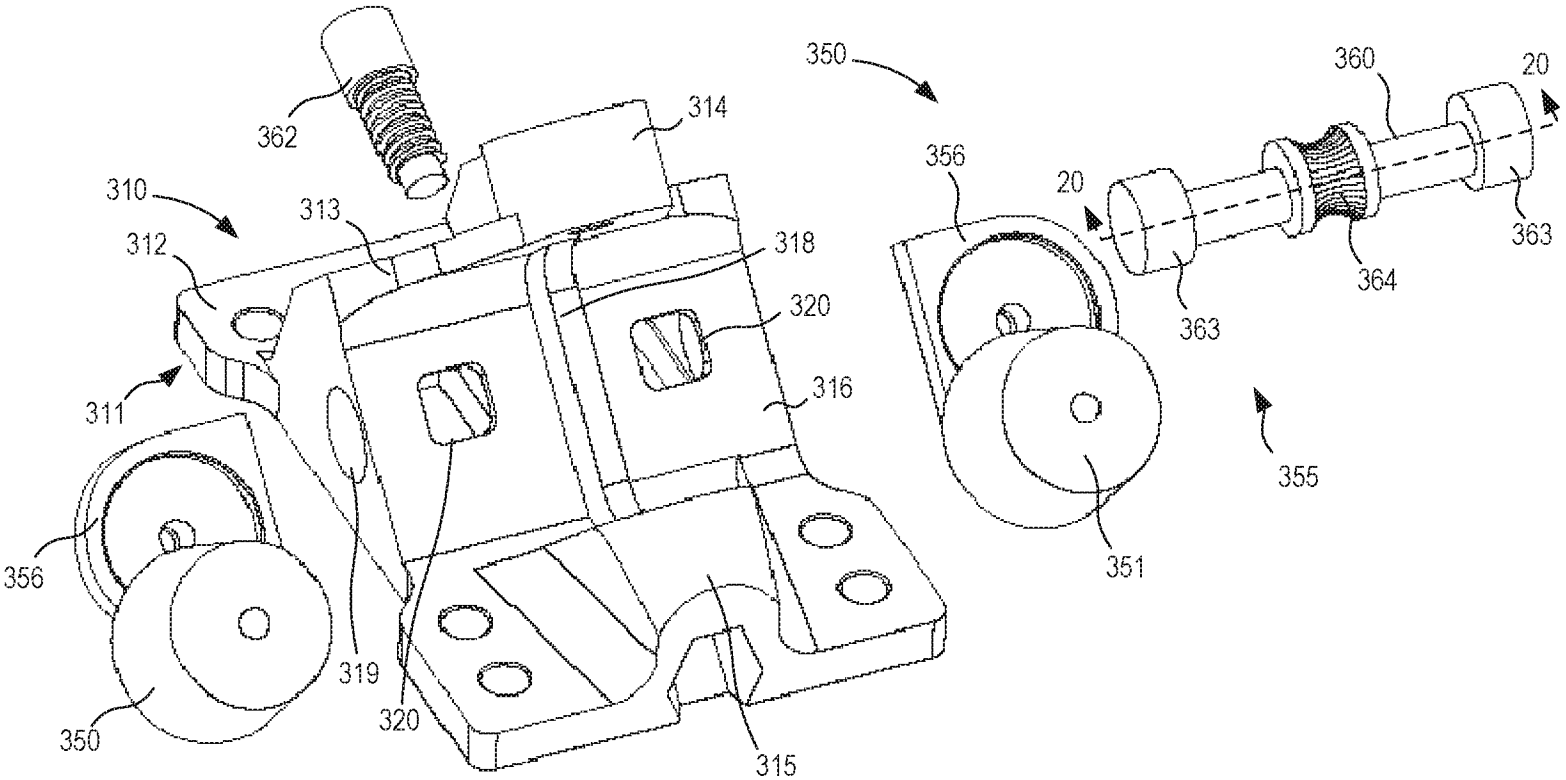
FIG. 18 is an exploded view of a portion of the truck of FIG. 15 illustrating a base plate and a bushing assembly.

As shown in FIGS. 17 and 18, the recessed surface 316 of the coupling portion 313 extends between the first coupler 314 and the second coupler 315. The recessed surface 316 includes a rib 318 and defines a set of openings 320. The rib 318 is substantially centered along a width of the recessed surface 318 and is configured to extend between the first coupler 314 and the second coupler 315. As such, the rib 318 can, for example, provide structural rigidity for the first coupler 314, the second coupler 315, and/or the coupling portion 313. In some embodiments, the rib 318 can be configured to engage a portion of the bushing assembly 350 to control a movement of at least a portion of the bushing assembly 350, as described in further detail herein. For example, in some embodiments, the arrangement of the rib 318 can substantially limit an amount of deformation (e.g., in an inward direction) of one or more bushings 351 included in the bushing assembly 350. As shown in FIG. 18, the recessed surface 316 defines two openings 320 disposed on opposite sides of the rib 318. Each opening 320 is configured to receive a portion of the bushing assembly 350, as described in further detail herein.

As shown in FIGS. 17 and 18, the first bore 319 and the second bore 319A are configured to receive a portion of the bushing assembly 250. More specifically, the bushing assembly 250 includes a bushing adjustment mechanism 255, which in turn, includes an adjustment pin 360 and a setscrew 362. The first bore 319 extends substantially through the coupling portion 313 of the base plate 310 and rotatably receives a portion of the adjustment pin 360 (see e.g., FIGS. 15-17). The second bore 319A extends through the coupling portion 313 at a substantially perpendicular angle to the first bore 319. In other words, the fore bore 319 defines an axis that extends substantially in a direction of the width of the base plate 310 (in at least one plane) and the second bore 319A defines an axis that extends substantially in a direction of the length of the base plate 310 (in at least one plate). The second bore 319A is configured to receive the setscrew 362, which can be advanced within the second bore 319A to be disposed in a desired position relative to the adjustment pin 360, as described in further detail herein.

The bushing assembly 350 of the truck 300 is configured to be disposed between the base plate 310 and the hanger 330. The bushing assembly 350 can be any suitable assembly, mechanism, and/or member configured to selectively engage a portion of the base plate 310 and the hanger 330 to control movement of the hanger 330 relative to the base plate 310. As shown, for example, in FIGS. 17-22, in this embodiment, the bushing assembly 350 includes two bushings 351 and a bushing adjustment mechanism 355. The bushings 351 can be similar to or substantially the same as the bushings 251 included in the bushing assembly 250. Thus, the form and/or function of the bushings 351 are not described in further detail herein. As shown, for example, in FIG. 18, the arrangement of the bushing assembly 350 is such that one of the bushings 351 (e.g., a first bushing) is disposed on a first side of the kingpin 370 and in contact with the contact portion 331 of the hanger 330, and the other bushing 351 (e.g., a second bushing) is disposed on a second side of the kingpin 370 and in contact with the contact portion 331 of the hanger 330. In this manner, rotation of the hanger 330 about the kingpin 370 (e.g., relative to the base plate 310) in a first direction can, for example, exert a first force on the first bushing 351, while rotation of the hanger 330 about the kingpin 370 in a second direction can, for example, exert a second force on the second bushing 351, as described in further detail herein.

Figure 19:
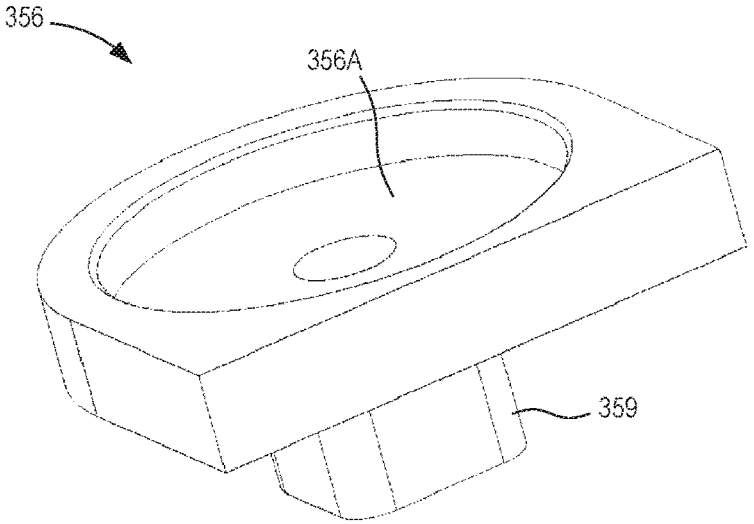
FIG. 19 is a perspective view of a bushing plate included in the bushing assembly of FIG. 18.

The bushing adjustment mechanism 355 of the bushing assembly 350 can be any suitable configuration and/or can have any suitable arrangement. As shown in FIGS. 18-22, the bushing adjustment mechanism 355 includes two bushing plates 356, the adjustment pin 360, and the setscrew 362. Each of the bushing plates 356 includes a recessed surface 356A and a post 359, as shown in FIG. 19. The recessed surface 356A of each bushing plate 356 is configured to receive and/or otherwise is configured to be coupled to a portion of one of the bushings 351, as described above with reference to the bushing plates 256. The post 359 of each bushing plate 356 is configured to be movably disposed within its associated opening 320 defined by the recessed surface 316 of the base plate 310 and is configured to engage and/or contact a portion of the adjustment pin 360 to move the bushing plate 356 relative to the base plate 310. The motion of the bushing plate 356, in turn moves the bushings 351 relative to the hanger 330, as described in further detail herein.

As shown in FIGS. 10 and 11, the bushing adjustment mechanism 355 is movably and/or adjustably coupled, for example, to the recessed surface 316 of the base plate 310. For example, in this embodiment, each bushing plate 356 is inserted into its associated slot 317 defined by the base plate 310. The arrangement of the bushing plates 356 is such that as each bushing plate 356 is inserted into its associated slot 317, a portion of the recessed surface 317 of the base plate 310 is inserted into the channels 358 defined by that bushing plate 356. As such, the bushing plates 356 can be moved in a transverse direction within the slot 317 between, for example, a first position (e.g., an inward position and/or a position otherwise closer to, for example, the kingpin 370) to a second position (e.g., an outward position and/or a position otherwise farther from the kingpin 370). Moreover, in some embodiments, the rib 318 of the base plate 310 can limit and/or otherwise define a range of inward movement of the bushing plates 356 relative to the base plate 310.

Figure 20:
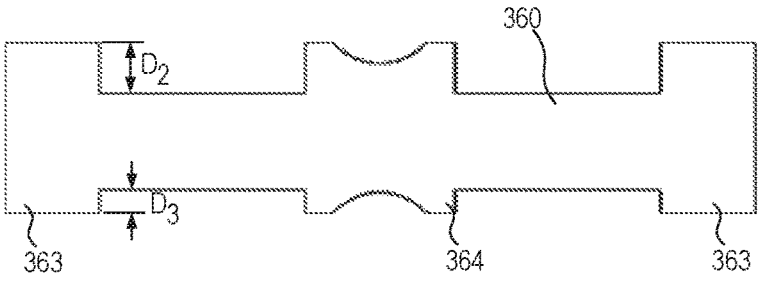
FIG. 20 is a cross-sectional view of an adjustment pin included in the bushing assembly of FIG. 18 and taken along the line 20-20.

The adjustment pin 360 can be any suitable shape, size, and/or configuration. For example, in the embodiment illustrated in FIGS. 15-22, the adjustment pin 360 is a cam and/or camshaft. More specifically, as shown in FIG. 20, the adjustment pin 360 includes two end cams 363 disposed at opposite ends of the adjustment pin 360 and an adjustment cam 364 disposed substantially in the center of the adjustment pin 360. The arrangement of the adjustment pin 360 is such that the end cams 363 and the adjustment cam 364 are substantially off-center relative to the remaining portions of the adjustment pin 360. For example, as shown by the cross-sectional view of FIG. 22, a first distance $D_2$ is defined between a first side of the adjustment pin 360 and a corresponding first side of the cams 363 and 364 and a second distance $D_3$, less than the first distance $D_2$, is defined between a second side of the adjustment pin 360 and a corresponding second side of the cams 363 and 364.

As described above, the adjustment pin 360 of the bushing assembly 350 is configured to be rotatably disposed within the first bore 319 defined by the base plate 310. More particularly, the end cams 363 and the adjustment cam 364 are disposed within the first bore 319 and/or are otherwise in contact with the surfaces of the base plate 310 that define the first bore 319. Therefore, the cams 363 and 364 rotate within the first bore 319 about an axis that is offset, for example, from a longitudinal centerline of the remaining portions of the adjustment pin 360. As such, when the cams 363 and 364 are rotated within the first bore 319, the remaining portion of adjustment pin 360 circumscribes a circle having a radius that is greater than a radius of that remaining portion. As described in further detail herein, the posts 359 of the bushing plates 356 extend through the openings 320 and are in contact with such portions of the adjustment pin 360 and thus, as the adjustment pin 360 is rotated within the first bore 319, the bushing plates 356 are moved closer to or farther away from the recessed surface 316 of the base plate 310.

Figure 21:
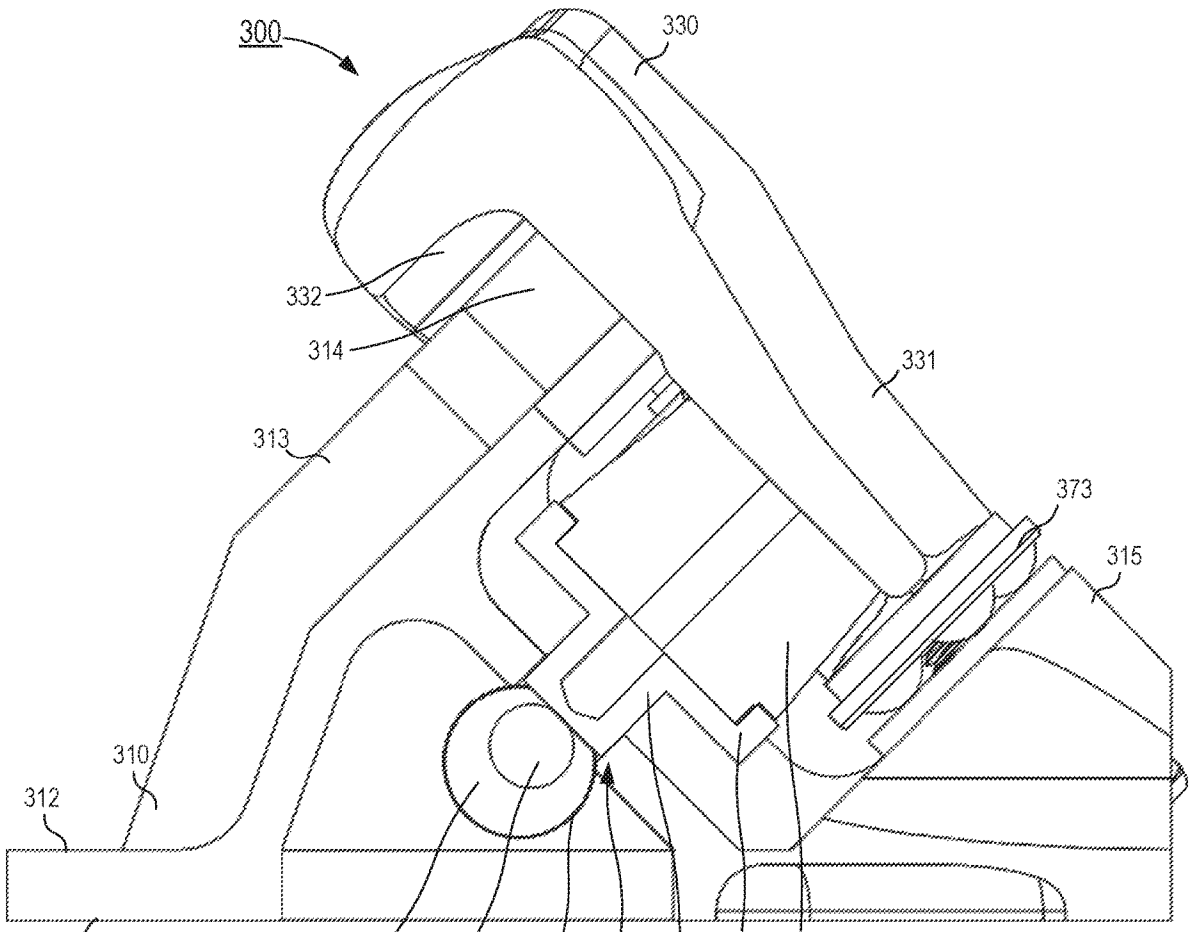
FIG. 21 is a cross-sectional view of the truck of FIG. 15 in a first configuration, taken along the line 21-21 in FIG. 16.
Figure 22:
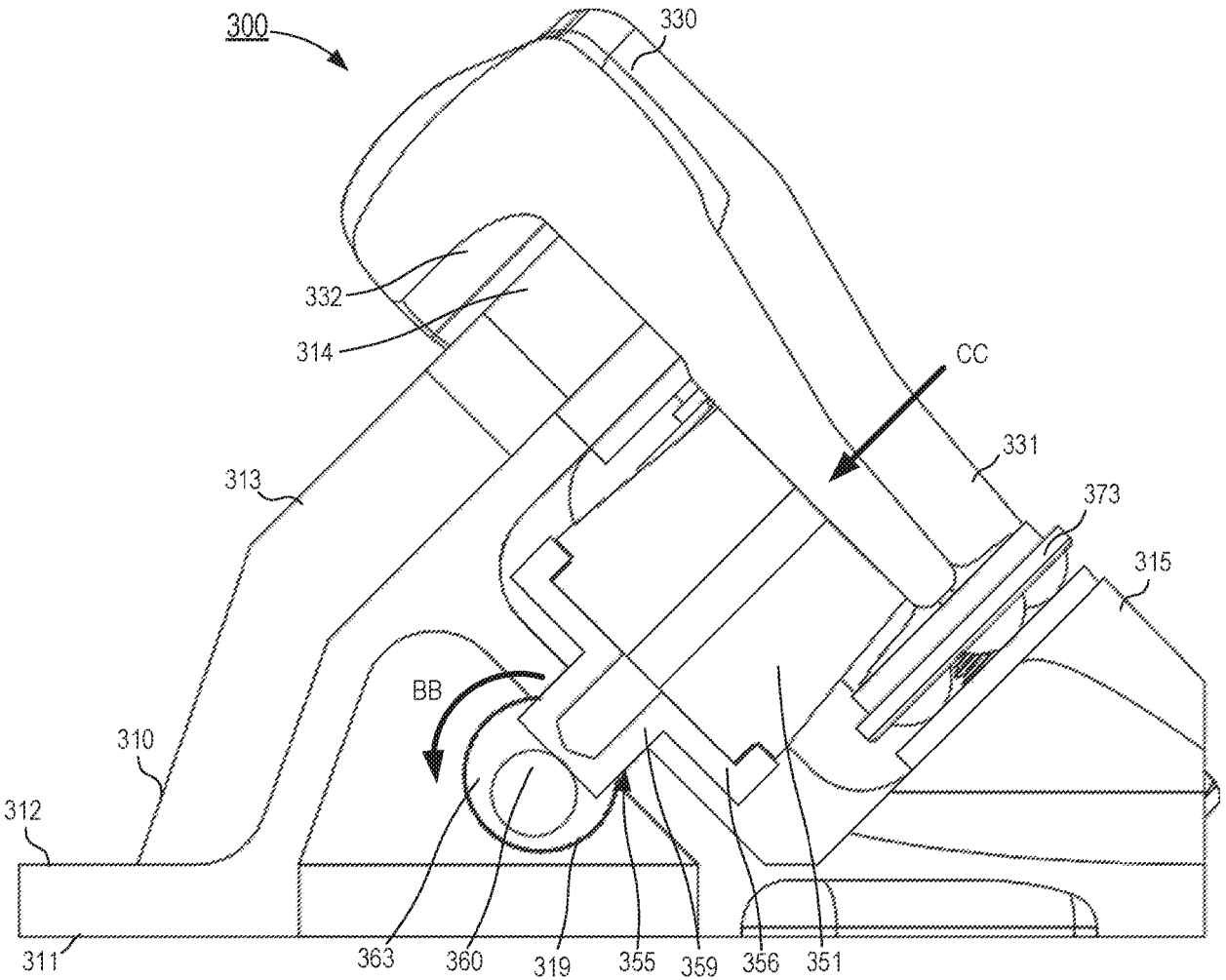
FIG. 22 is a cross-sectional view of the truck of FIG. 21 in a second configuration.

As described above, the setscrew 362 of the bushing assembly 350 is configured to be disposed within the second bore 319A defined by the base plate 310. As shown, for example, in FIG. 18, the arrangement of the base plate 310, the adjustment pin 360, and the setscrew 362 is such that the setscrew 362 engages the adjustment cam 364 of the adjustment pin 360. In this manner, the adjustment cam 364 and the setscrew 362 can collectively form a worm gear connection or the like in which, rotation of the setscrew 362 results in rotation of the adjustment cam 364. Thus, with the posts 359 of the bushing plates 356 in contact with the adjustment pin 360 rotation of the setscrew 362 is operative to move the bushing plates 356 closer to or farther away from the recessed surface 316 of the base plate 310. For example, in some instances, a user can rotate the setscrew 362 to place the adjustment pin 360 in a position in which the adjustment pin 360 places the bushing plate 356 at a position that is substantially at a maximum distance from the recessed surface 316, as shown in FIG. 21. Conversely, in other instances, a user can rotate the setscrew 362 to rotate the adjustment pin 360 within the first bore 319A, as indicated by the arrow BB in FIG. 22. In this manner, the adjustment pin 360 can move the base plates 356 toward the recessed surface 316, as indicated by the arrow CC in FIG. 22.

With the hanger 330 disposed about the kingpin 370 and with the kingpin 370 fixedly coupled to the first coupler 314 and the second coupler 315 of the base plate 310, movement of the bushing plates 356, for example, away from the recessed surface 316 compresses the bushings 351 between the bushing plate 356 and the contact portion 331 of the hanger 330. In other words, moving the bushing plate 356 away from the recessed surface 316 of the base plate 310 increases internal stresses within the bushing 351 and/or otherwise pre-loads the bushing 351. With the bushings 356 at least partially compressed, a force sufficient to result in further compression is greater than a force that otherwise sufficient to result in an initial compression of the bushing 351 (e.g., transitioning the bushing 351 from a substantially uncompressed state to an at least partially compressed state). Thus, moving the bushing plates 356 away from the recessed surface 316 of the base plate 310 results in the bushings 351 resisting a greater portion of a force associated with the rotation of the hanger 330 than a portion of the force resisted when the bushing plates 356 are closer to the recessed surface 316. Stated simply, a force sufficient to rotate the hanger 330 about the kingpin 370 is increased when the base plate 356 is moved away from the recessed surface 316 of the base plate 310. Thus, a user can adjust the turning characteristics associated with the truck 300 by moving the bushing plates 356 closer to or farther away from the base plate 310.

Figure 23:
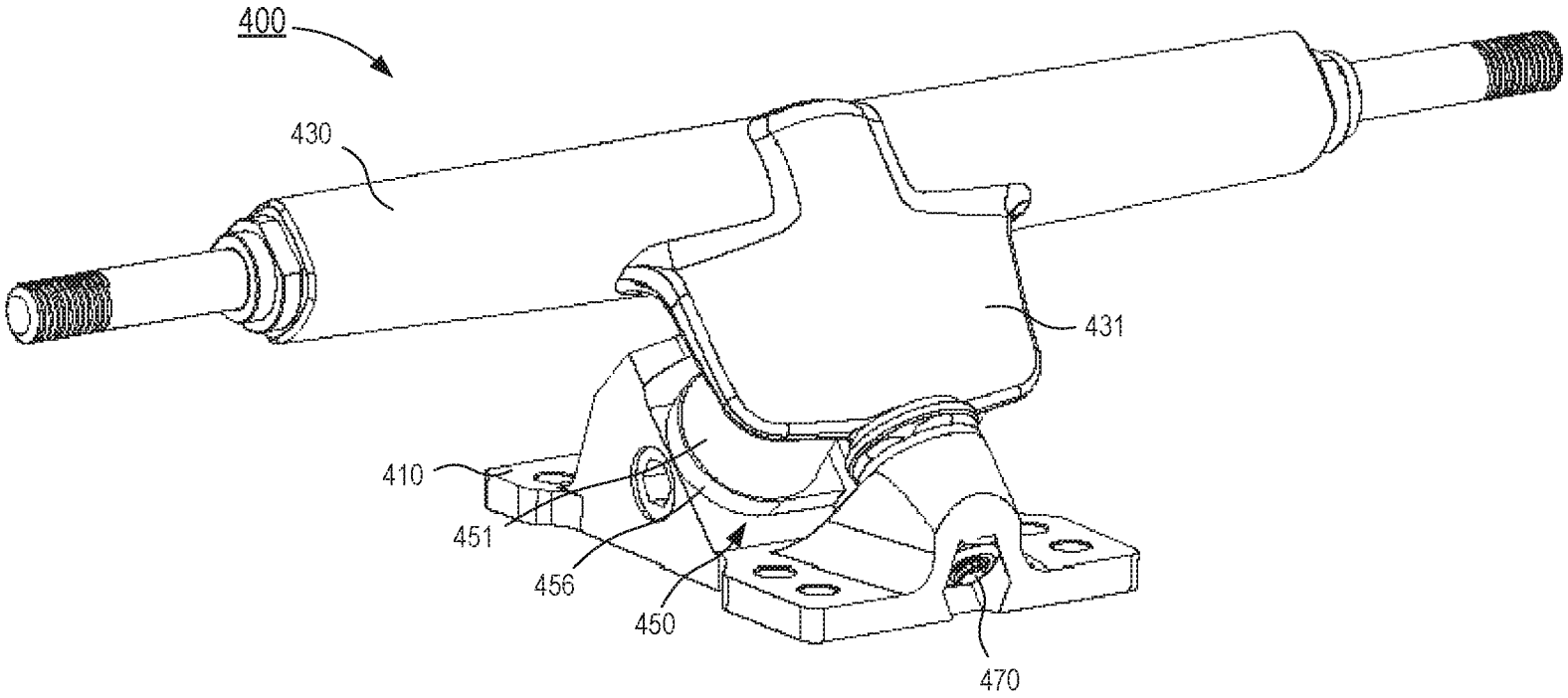
FIG. 23 is a perspective view of a truck according to another embodiment.
Figure 24:
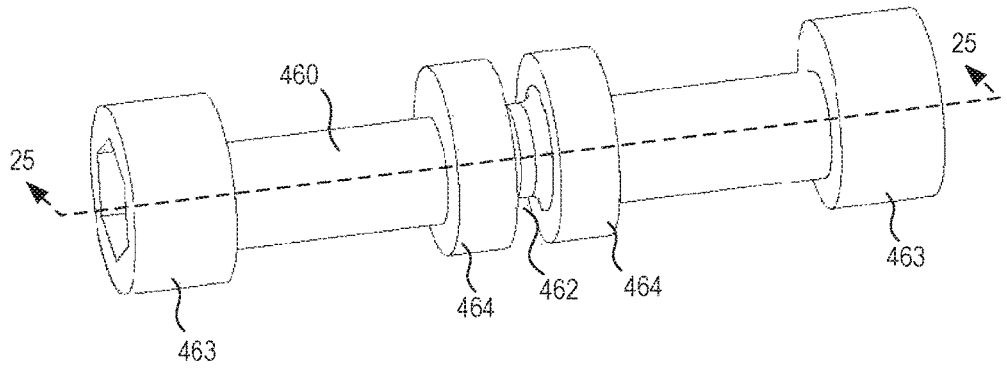
FIG. 24 is a perspective view of an adjustment pin included in the truck of FIG. 23.

While the bushing assembly 350 is shown and described above with reference to FIGS. 15-22 as including the setscrew 362 that is configured to rotate the adjustment pin 360 within the first bore 319, in other embodiments, a truck can include an adjustment pin that is configured to rotate within a bore in any suitable manner. For example, FIGS. 23-24 illustrate a truck 400 according to another embodiment. In some embodiments, the truck 400 can be included in, for example, a skateboard, roller skate, and/or the like (not shown), as described above with reference to the truck 200. Therefore, in use, the truck 400 can be in a "front" position or a "rear" position of a skateboard, roller skate, etc.

As shown in FIG. 23, the truck 400 includes a base plate 410, a hanger 430, a bushing assembly 450, and a kingpin 470. In some embodiments, portions of the truck 400 can be substantially similar in form and/or function as associated portions of the truck 200 described above with reference to FIGS. 2-14, and/or the truck 300 described above with reference to FIGS. 15-22. Thus, such portions of the truck 400 are not described in further detail herein and should be considered substantially the same as the associated portions of the truck 200 and/or 300 unless the context clearly states otherwise. For example, the base plate 410, the hanger 430, and the kingpin 470 can be similar to or substantially the same as the base plate 310, the hanger 330, and the kingpin 370, respectively, described above with reference to FIGS. 15-22. Thus, the base plate 410, the hanger 430, and the kingpin 470 are not described in further detail herein.

Figure 25:
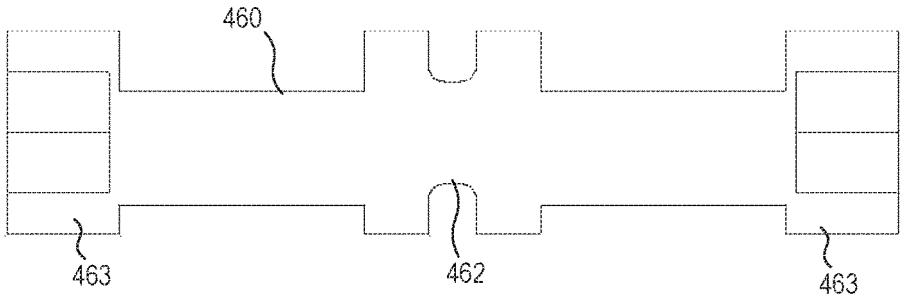
FIG. 25 is a cross-sectional view of the adjustment pin of FIG. 24 taken along the line 25-25 in FIG. 24.

The bushing assembly 450 can be substantially similar to the bushing 350 included in the truck 300 of FIGS. 15-22. The bushing assembly 450 can differ, however, in the arrangement of an adjustment pin 460 included therein. For example, as shown in FIGS. 24 and 25, the bushing assembly 450 includes the adjustment pin 460, which has two end cams 463 and two inner cams 464. As shown in FIG. 24, the two inner cams 464 collectively define a channel 462. As described above with reference to the bushing assembly 250 included in the truck 200 of FIGS. 2-14, the bushing assembly 450 can include a setscrew (not shown in FIGS. 23-25) that is configured to be at least partially disposed in the channel 462. More specifically, the base plate 410 can define a first bore (not shown) in which the adjustment pin 460 can be disposed and a second bore (not shown) in which the setscrew is disposed such that at least a portion thereof is disposed in the channel 462. Thus, the setscrew can maintain the adjustment pin 460 in a substantially fixed lateral or transverse direction while allowing the adjustment pin 460 to rotate within the first bore of the base plate. In this embodiment, since the setscrew does not engage, for example, an adjustment cam, the adjustment pin 460 can be rotated via engagement with, for example, the end cams 463. For example, in some embodiments, the end cams 463 can form a hex head, star head, Philips head, a bolt head, and/or any other suitable configuration enabling engagement with and rotation of the adjustment pin 460. Thus, a user can rotate the adjustment pin 460 to move at least one bushing plate 456 and bushing 451 closer to or away from a contact portion 431 of the hanger 430, as described in detail above with reference to the truck 300 of FIGS. 15-22.

While the trucks 200, 300, and 400 each include bushing assemblies with bushing plates configured to move a set of bushings relative to a base plate, in other embodiments, a truck can include any suitable bushing and/or bushing assembly. For example, FIGS. 26-29 illustrate a truck 500 according to another embodiment. In some embodiments, the truck 500 can be included in, for example, a skateboard, roller skate, and/or the like (not shown), as described above with reference to the truck 200. Therefore, in use, the truck 500 can be in a "front" position or a "rear" position of a skateboard, roller skate, etc.

As shown in FIGS. 26-29, the truck 500 includes a base plate 510, a hanger 530, a bushing assembly 550, and a kingpin 570. In some embodiments, portions of the truck 500 can be substantially similar in form and/or function as associated portions of the truck 200 described above with reference to FIGS. 2-14. Thus, such portions of the truck 500 are not described in further detail herein and should be considered substantially the same as the associated portions of the truck 200 unless the context clearly states otherwise.

Figure 26:
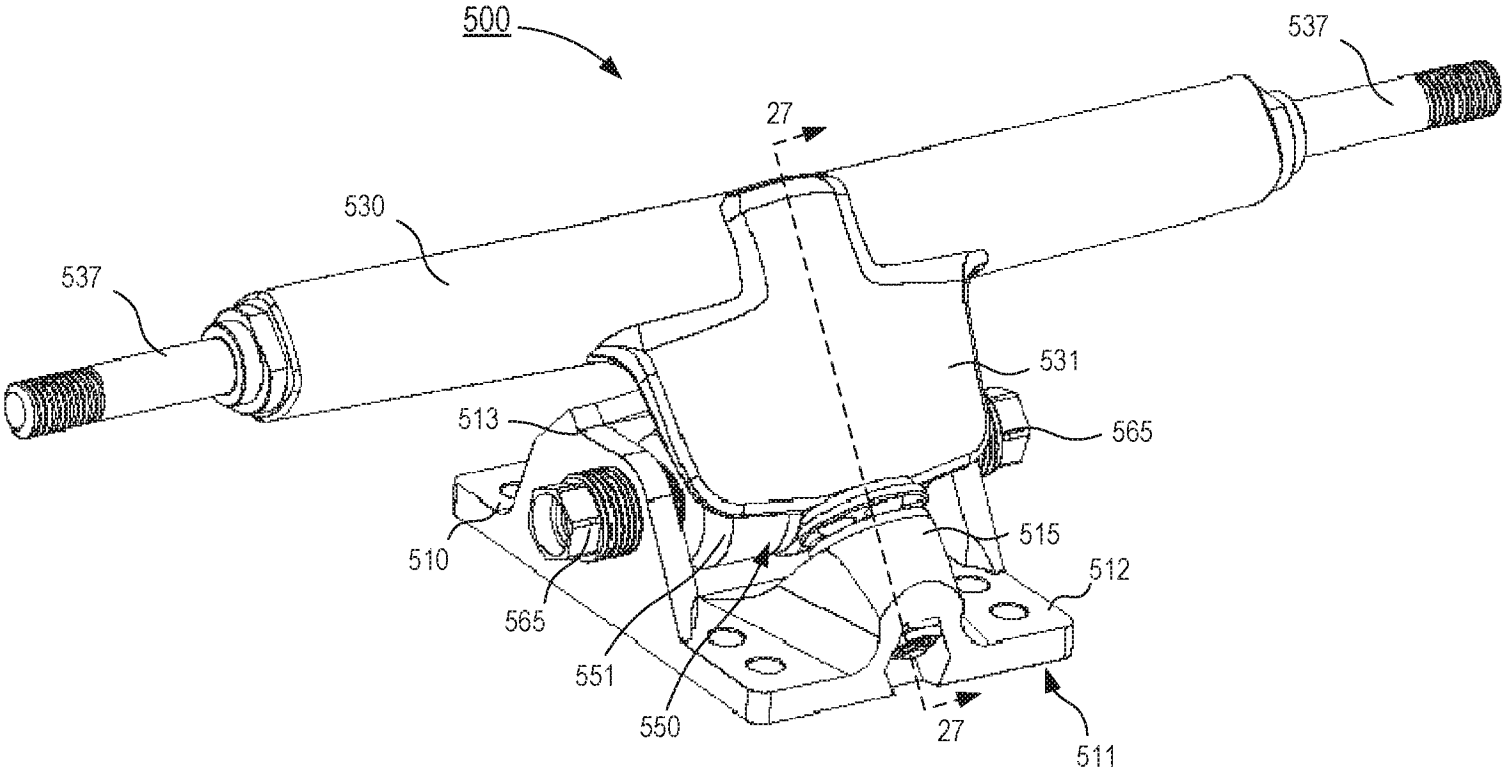
FIG. 26 is a perspective view of a truck according to another embodiment.
Figure 27:
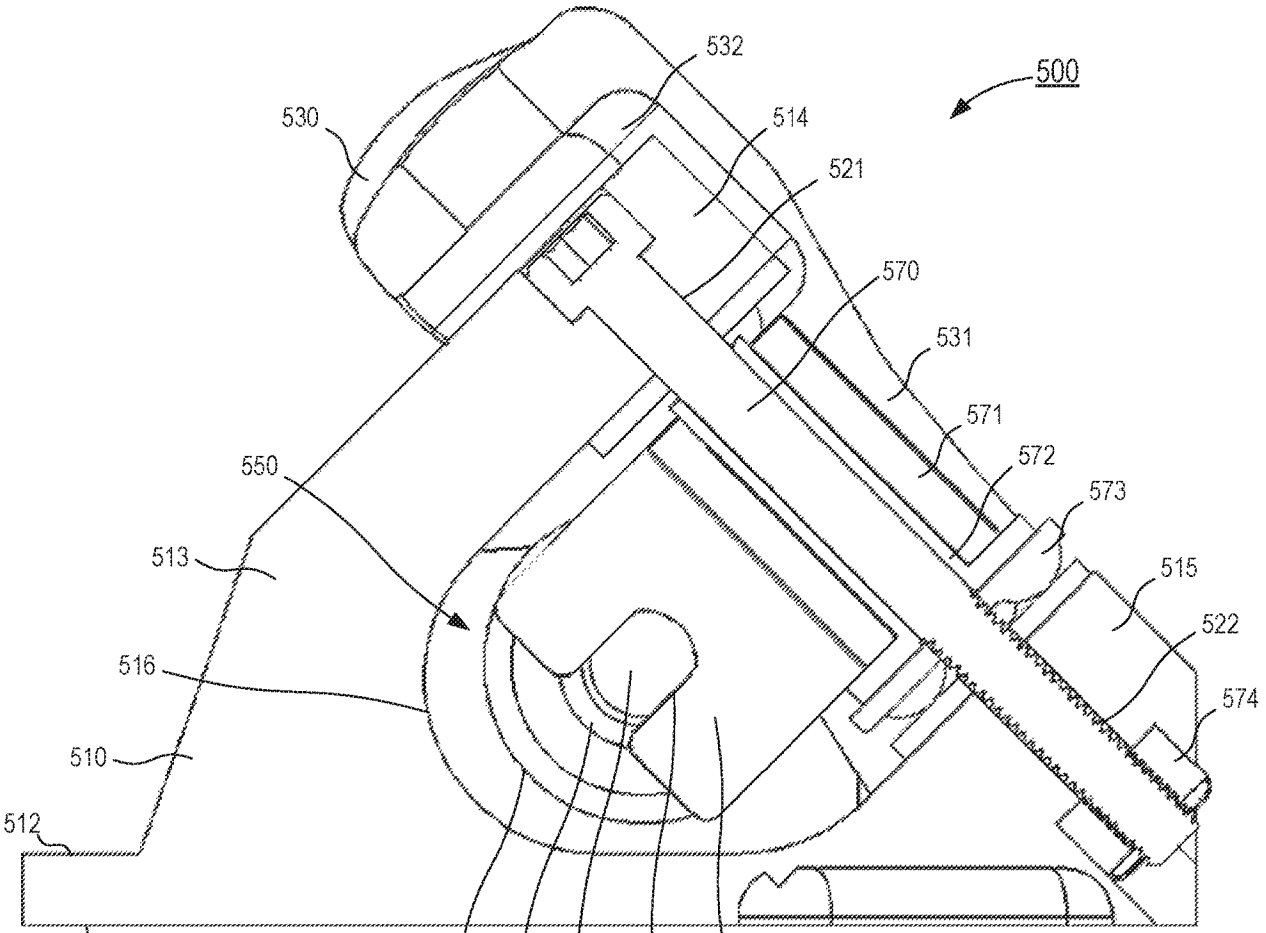
FIG. 27 is a cross-sectional view of the truck of FIG. 26 taken along the line 27-27.
Figure 28:
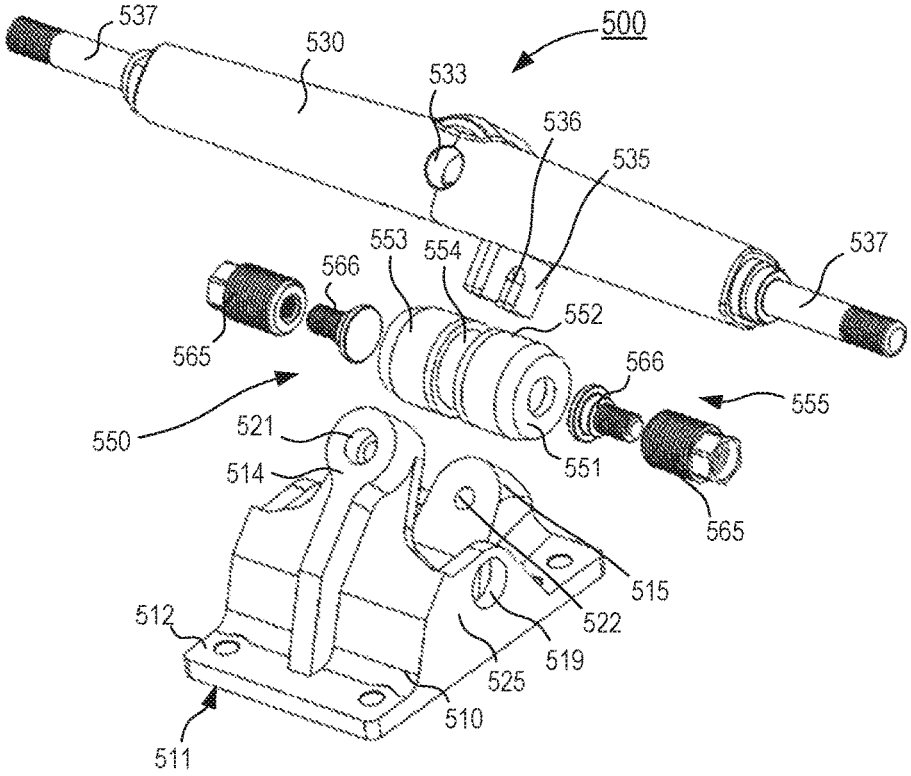
FIG. 28 is an exploded view of the truck of FIG. 26.

At least a portion of the hanger 530 of the truck 500 is substantially similar to the hanger 230 of the truck 200 described above with reference to FIGS. 7-9 and thus, portions of the hanger 530 are not described in further detail herein. As shown in FIGS. 27 and 28, the hanger 530 defines a slot 532 and aperture 533 and includes and/or forms a contact portion 531 and a pair of axles 537. The slot 532 is configured to receive a first coupler 514 of the base plate 510, the aperture 533 is configured to receive a portion of the kingpin 570, and the contact portion 531 is configured to be in contact with a portion of the bushing assembly 550 (FIGS. 26-28). The axles 537 of the hanger 530 can each be independently coupled to and/or formed with the hanger 530 such that a single axle does not extend substantially through the width of the hanger 530. Thus, the first coupler 514 can be disposed in the slot 532 and the kingpin 570 can be disposed in the aperture 533, as described above with reference to the hanger 230.

As described above with reference to the truck 200, the aperture 533 of the hanger 530 is configured to receive the kingpin 570, an inner sleeve 571, and a bearing 572. The arrangement of the portion of the kingpin 570, the inner sleeve 571, and the bearing 572 within the aperture 533 of the hanger 530 is similar to or substantially the same as the arrangement of the kingpin 270, the inner sleeve 271, and the bearing 272 within the aperture 233 of the hanger 230 and thus, is not described in further detail herein. In addition, the truck 500 includes a damper 573 disposed between the bearing 572 and/or the hanger 530 and a second coupler 515 of the base 510, as described above with reference to the damper 273. The damper 573 of the truck 500 is substantially similar in form and function as the damper 273 of the truck 200 and thus, is not described in further detail herein.

As shown in FIGS. 27 and 28, the hanger 530 can differ from the hanger 230, however, with the inclusion of a tab 535 extending from the contact portion 531. The tab 535 defines a slot 536 configured to receive a portion of the bushing assembly 550. The tab 535 of the hanger 530 is configured to engage one or more bushings 551 included in the bushing assembly 550, which in turn, is/are configured to exert a reaction force on the tab 535 in response to a rotation of the hanger 530 about the kingpin 570, as described in further detail herein.

Figure 29:
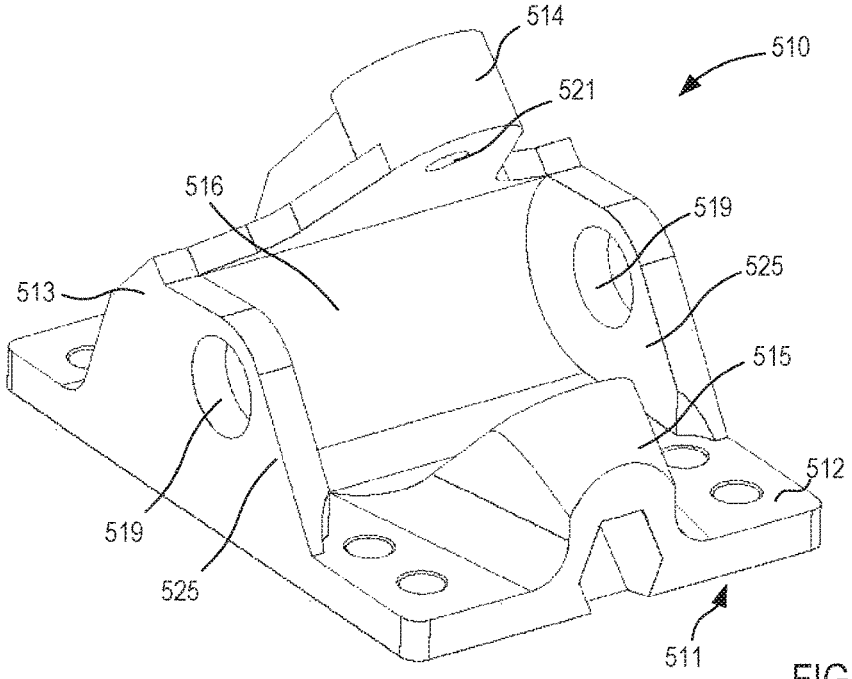
FIG. 29 is a perspective view of a base plate included in the truck of FIG. 26.

The base plate 510 of the truck 500 can be any suitable shape, size, and/or configuration. As shown in FIGS. 28 and 29, the base plate 510 has a first surface 511 and a second surface 512 and includes and/or otherwise forms a coupling portion 513. The first surface 511 of the base plate 510 is configured to be mounted, for example, to a bottom surface of a skateboard deck or the like, thereby positioning the hanger 530 beneath the bottom surface of the deck when coupled thereto. The mechanics of coupling the truck 500 to the deck of a skateboard using bolts, screws, etc. can be similar to known bottom-mounted skateboard configurations, and thus, is not described in further detail herein.

The coupling portion 513 of the base plate 510 extends from the second surface 512 of the base plate 510 and includes the first coupler 514, the second coupler 515, a set of sidewalls 525, and a recessed surface 516. The first coupler 514 and the second coupler 515 each define an opening 521 and 522, respectively, configured to receive a different portion of the kingpin 570 (see e.g., FIGS. 27 and 28). In this embodiment, the arrangement and/or function of the first coupler 514 and the second coupler 515 is similar to or substantially the same as the first coupler 214 and the second coupler 215 of the base plate 210 of FIGS. 5 and 6. Thus, the first coupler 514 and the second coupler 515 are not described in further detail herein. As shown in FIG. 29, the recessed surface 516 of the coupling portion 513 extends between the first coupler 514 and the second coupler 515 and the set of sidewalls 525. The sidewalls 525 each define an opening 519 configured to receive a portion of the bushing assembly 550, as described in further detail herein.

The bushing assembly 550 of the truck 500 is configured to be at least partially disposed between the base plate 510 and the hanger 530. The bushing assembly 550 can be any suitable assembly, mechanism, and/or member configured to selectively engage a portion of the base plate 510 and the hanger 530 to control movement of the hanger 530 relative to the base plate 510. As shown, for example, in FIGS. 27 and 28, in this embodiment, the bushing assembly 550 includes a bushing 551 and a bushing adjustment mechanism 555. The bushing 551 can be substantially similar in at least function to the bushings 251 included in the bushing assembly 250. Thus, portions of the bushings 551 are not described in further detail herein. While the bushings 251 included in the truck 200 were, for example, disposed in a vertical orientation and in contact with the contact portion 231 of the hanger 230, in this embodiment, the bushing 551 is, for example, disposed in a horizontal orientation and in contact with the tab 535 extending from the contact portion 531.

As shown in FIGS. 27 and 28, the arrangement of the bushing assembly 550 is such that a first portion 552 of the bushing 551 is disposed on a first side of the tab 535 and in contact therewith, and a second portion 553 of the bushing 551 is disposed on a second side of the tab 535 and in contact therewith. More particularly, at least a portion of the tab 535 is disposed within a channel 554 or space defined between the first and second portions of the bushing 551. In other embodiments, the bushing assembly 550 can include two bushings 551 that collectively define the channel 554 therebetween. In this manner, rotation of the hanger 530 about the kingpin 570 (e.g., relative to the base plate 510) in a first direction can, for example, exert a first force on the first portion 552 of the bushing 551 (or on a first bushing), while rotation of the hanger 530 about the kingpin 570 in a second direction can, for example, exert a second force on the second portion 553 of the bushing 551 (or on a second bushing), as described in further detail herein.

The bushing adjustment mechanism 555 can be any suitable configuration and/or can have any suitable arrangement. As shown in FIGS. 26 and 28, the bushing adjustment mechanism 555 includes two contact members 566 (e.g., adjustment pins) and two compression members 565. The contact members 566 can be any suitable pin or the like configured to support the bushing 551. Each contact member 566 is configured to be at least partially disposed within opposite portions of the bushing 551. In some embodiments, a portion of the contact members 566 is disposed within the openings 519 defined by the sidewalls 525 of the base plate 510. Moreover, at least a portion of the contact members 566 can form and/or can have a threaded portion configured to form a threaded coupling with the compression members 565. As such, the contact members 566 can be configured to suspend the bushing 551 within a space defined at least in part by the sidewalls 525 and the recessed surface 516.

The compression members 565 are configured to engage the contact members 566 to apply a compressive force to the bushing 551. More specifically, as shown in FIG. 26, the compression members 565 are disposed within the openings 519 defined by the sidewalls 525 of the base plate 510. In some embodiments, the compression members 565 can form a threaded coupling with a surface of the sidewalls 525 defining the openings 519 and can form, at least indirectly, a threaded coupling with the contact members 566. This arrangement is such that when the compression members 565 are moved within the opening 519, the compression members 565 move the contact members 566 relative to the bushing 551. Thus, when the compression members 565 are advanced within their associated opening 519 toward the bushing 551, the contact members 566 exert a compression force on opposite sides of the bushing 551. Conversely, when the compression members 565 are moved within their associated opening 519 away from the bushing 551, the compression force exerted on opposite sides of the bushing 551 is reduced. In some instances, the arrangement of the bushing assembly mechanism 555 can be such that the contact members 551 exert a force on the bushing 551 that is opposite the compression force, thereby placing the bushing 551 in tension.

In use, the internal stress within the bushing 551 in a transverse direction (e.g., in a direction of a longitudinal axis defined by the contact members 566) can be increased or decreased, which in turn, can decrease or increase, respectively, an amount of force that is otherwise sufficient to rotate the hanger 530 about the kingpin 570. For example, in some instances, the compression members 565 can be moved within their associated opening 519 to move the contact members 566 in an inward direction, thereby increasing an internal stress within the bushing 551 (e.g., placing the bushing 551 in compression). The increased internal stress within the bushing 551 decreases an amount of deformation of the bushing 551 when exposed to an applied force. Thus, when the hanger 530 is rotated about the kingpin 570 and the tab 535 exerts a force on the bushing 551, deformation of the bushing 551 in response to the force is reduced, which in turn, reduces a rotational range of motion of the hanger 530 about the kingpin 570. In other instances, when the compression members 565 and the contact members 566 are moved relative to the base plate 510 to reduce the compression force exerted on the bushing 551 and the tab 535 exerts substantially the same force on the bushing 551, the deformation of the bushing 551 is increased, thereby increasing the rotational range of motion of the hanger 530 about the kingpin 570.

Figure 30:
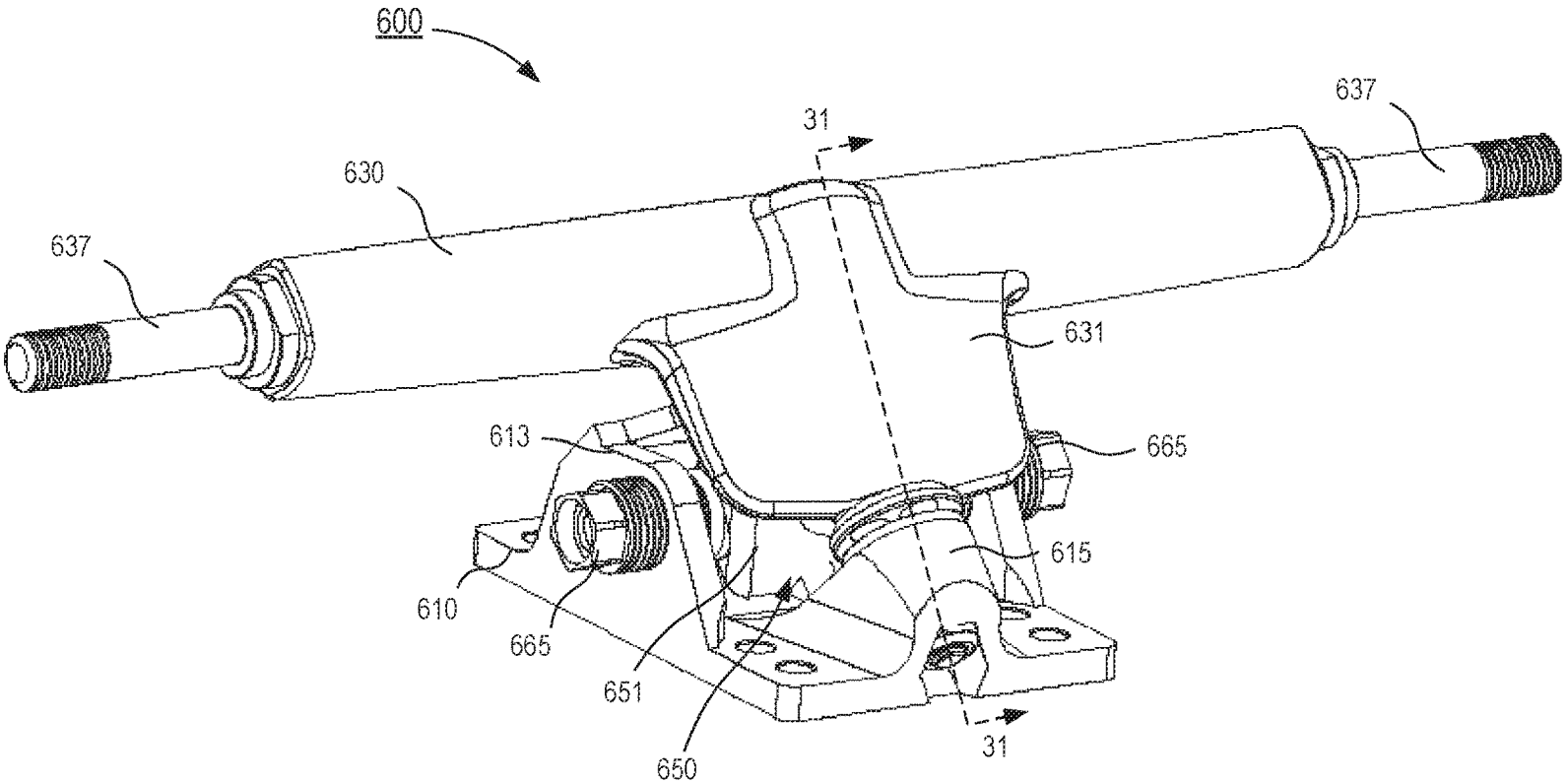
FIG. 30 is a perspective view of the truck according to another embodiment.
Figure 31:
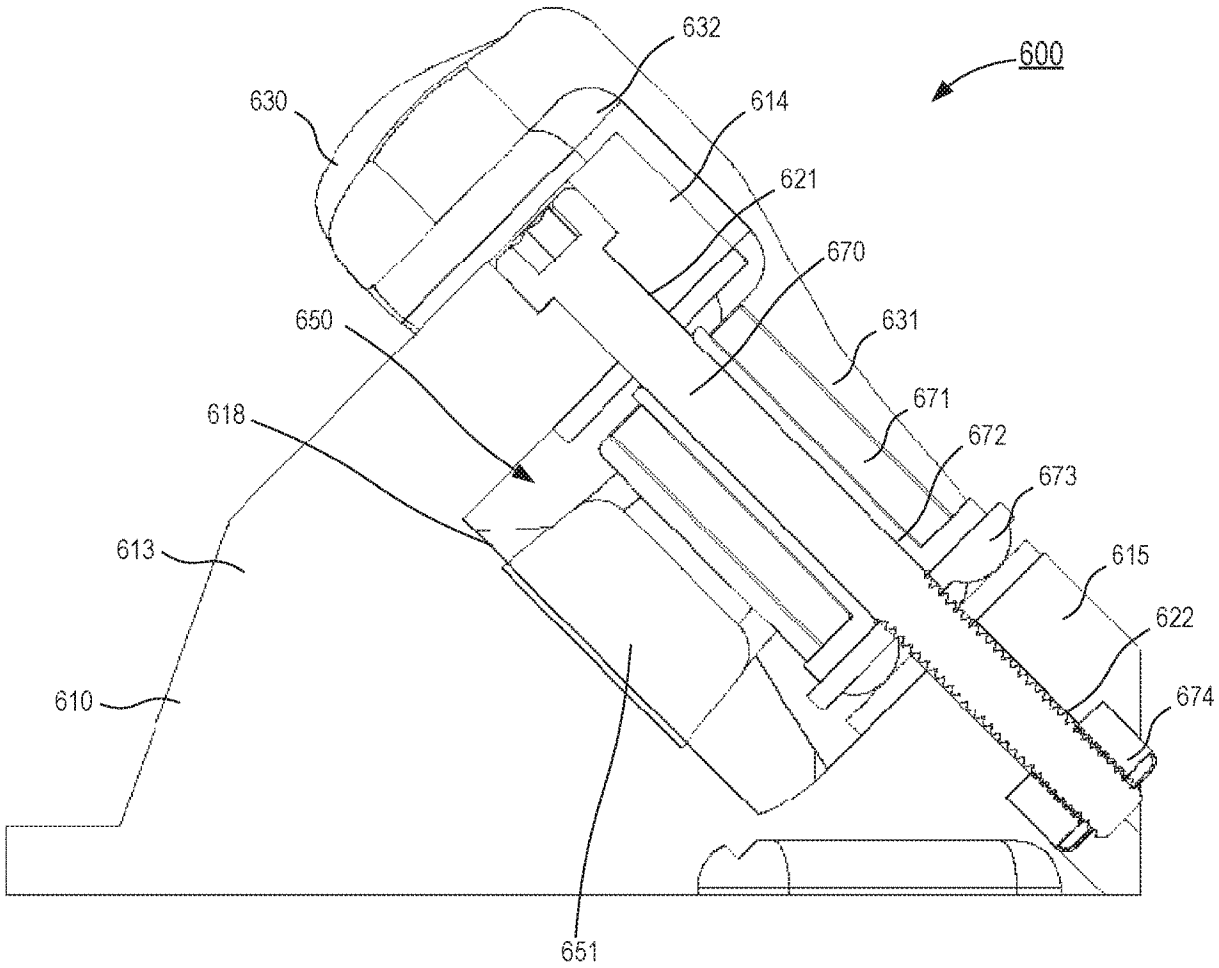
FIG. 31 is a cross-sectional view of the truck of FIG. 30 taken along the line 31-31.
Figure 32:
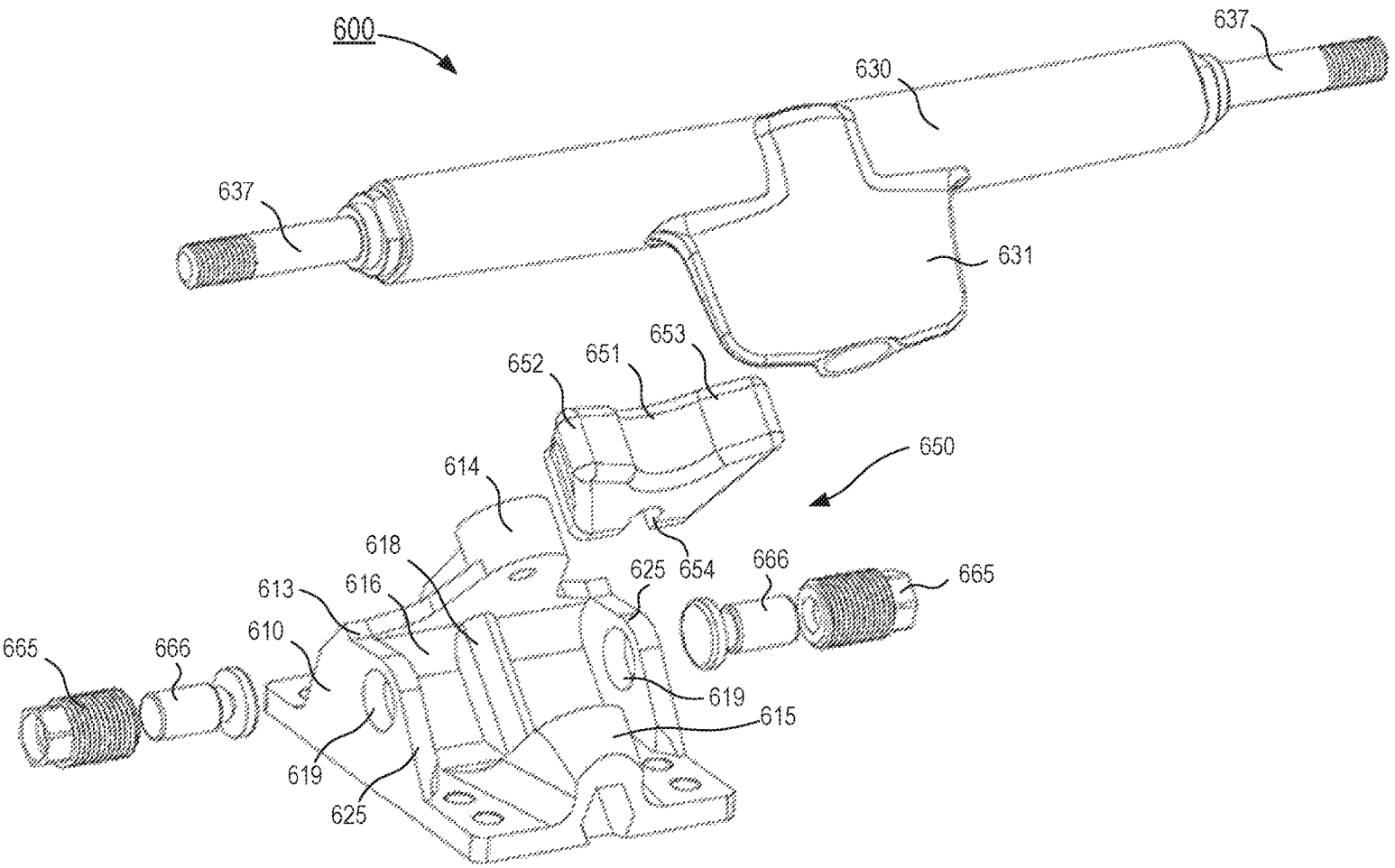
FIG. 32 is an exploded view of the truck of FIG. 30.
Figure 33:
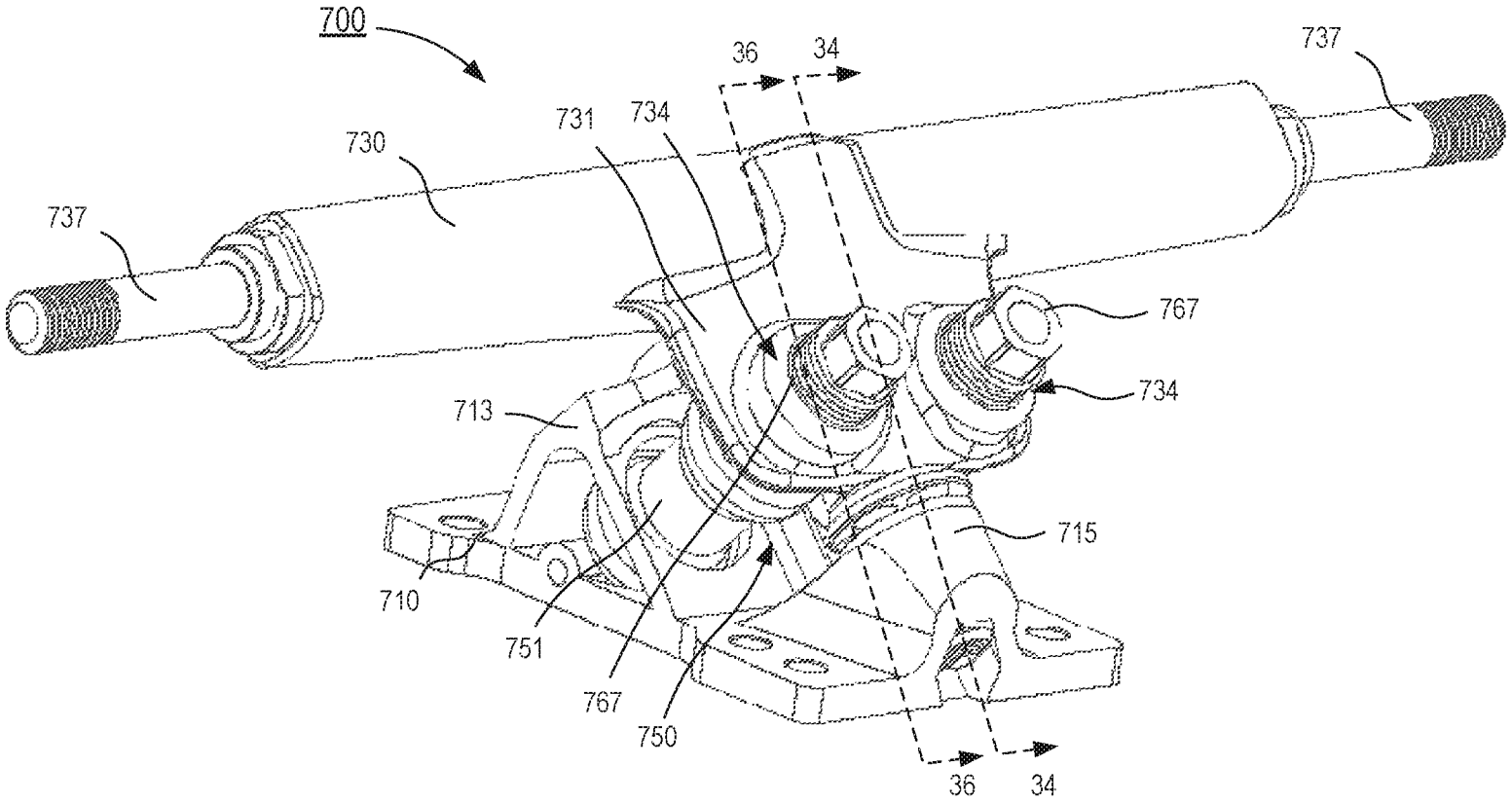
FIG. 33 is a perspective view of a truck according to another embodiment.

While the hanger 530 is described above as including the tab 535, which is configured to engage the bushing 551, in other embodiments, a bushing can engage a contact portion of a hanger in any suitable manner. For example, FIGS. 30-32 illustrate a truck 600 according to another embodiment. In some embodiments, the truck 600 can be included in, for example, a skateboard, roller skate, and/or the like (not shown), as described above with reference to the truck 200. Therefore, in use, the truck 600 can be in a "front" position or a "rear" position of a skateboard, roller skate, etc.

As shown in FIGS. 30-32, the truck 600 includes a base plate 610, a hanger 630, a bushing assembly 650, and a kingpin 670. In some embodiments, portions of the truck 600 can be substantially similar in form and/or function as associated portions of the truck 200 described above with reference to FIGS. 2-14 and/or truck 500 described above with reference to FIGS. 26-29. Thus, such portions of the truck 600 are not described in further detail herein and should be considered substantially the same as the associated portions of the truck 200 and/or 500 unless the context clearly states otherwise.

The hanger 630 of the truck 600 is substantially similar to the hanger 230 of the truck 200 described above with reference to FIGS. 7-9 and thus, portions of the hanger 630 are not described in further detail herein. As such, the following description of the hanger 630 is to identify features thereof and is not intended to limit the form and/or function of the hanger 630 unless the context clearly states otherwise. Specifically, as shown in FIGS. 31 and 32, the hanger 630 defines a slot 632 and aperture 633 and includes and/or forms a contact portion 631 and a pair of axles 637. The slot 632 is configured to receive a first coupler 614 of the base plate 610, the aperture 633 is configured to receive a portion of the kingpin 670, and the contact portion 631 is configured to be in contact with a portion of the bushing assembly 650. The axles 637 of the hanger 630 can each be independently coupled to and/or formed with the hanger 630 such that a single axle does not extend substantially through the width of the hanger 630. Thus, the first coupler 614 can be disposed in the slot 632 and the kingpin 670 can be disposed in the aperture 633.

As described above with reference to the truck 200, the aperture 633 of the hanger 630 is configured to receive the kingpin 670, an inner sleeve 671, and a bearing 672. The arrangement of the portion of the kingpin 670, the inner sleeve 671, and the bearing 672 within the aperture 633 of the hanger 630 is similar to or substantially the same as the arrangement of the kingpin 270, the inner sleeve 271, and the bearing 272 within the aperture 233 of the hanger 230 and thus, is not described in further detail herein. In addition, the truck 600 includes a damper 673 disposed between the bearing 672 and/or the hanger 630 and a second coupler 615 of the base 610, as described above with reference to the damper 273. The damper 673 of the truck 600 is substantially similar in form and function as the damper 273 of the truck 200 and thus, is not described in further detail herein.

The base plate 610 of the truck 600 can be any suitable shape, size, and/or configuration. The base plate 610 is configured to be mounted to, for example, a bottom surface of a skateboard deck or the like, as described above with reference to the base plate 210. In this embodiment, the arrangement of the base plate 610 is similar to or substantially the same as the base plate 510 of FIGS. 26-29 and thus, portions of the base plate 610 are not described in further detail herein. As such, the following description of the base plate 610 is to identify features thereof and is not intended to limit the form and/or function of the base plate 610 unless the context clearly states otherwise. Specifically, as shown in FIGS. 31 and 32, the base plate 610 has a coupling portion 613 including the first coupler 614, the second coupler 615, a set of sidewalls 625, and a recessed surface 616. The first coupler 614 and the second coupler 615 each define an opening 621 and 622, respectively, configured to receive a different portion of the kingpin 670 (see e.g., FIGS. 31 and 32). The base plate 610 can differ from the base plate 510, however, with the base plate 610 including and/or forming a rib 618 extending from the recessed surface 616 between the first coupler 614 and the second coupler 615. The rib 618 is configured to engage at least a portion of the bushing assembly 650 and can be substantially similar in form and/or function to the rib 218 of the base plate 210.

The bushing assembly 650 of the truck 600 is configured to be at least partially disposed between the base plate 610 and the hanger 630. The bushing assembly 650 can be any suitable assembly, mechanism, and/or member configured to selectively engage a portion of the base plate 610 and the hanger 630 to control movement of the hanger 630 relative to the base plate 610. As shown, for example, in FIGS. 31 and 32, in this embodiment, the bushing assembly 650 includes a bushing 651 and a bushing adjustment mechanism 655. The bushing 651 can be substantially similar in at least function to the bushings 251 included in the bushing assembly 250. Thus, portions of the bushings 651 are not described in further detail herein. As shown in FIG. 32, in this embodiment, the bushing 651 is substantially wedge-shaped and defines a recess 654 configured to receive a portion of the rib 618 of the base plate 610. As described above with reference to the base plate 210, the rib 618 can be configured to engage a portion of the bushing 651 to control a movement (e.g., an inward movement) of at least a portion of the bushing 651.

The arrangement of the bushing assembly 650 is such that a first portion 652 of the bushing 651 is disposed on a first side of the kingpin 670 and in contact with the contact portion 631 of the hanger 630, and a second portion 653 of the bushing 651 is disposed on a second side of the kingpin 670 and in contact with the contact portion 631 of the hanger 630. In this manner, rotation of the hanger 630 about the kingpin 670 (e.g., relative to the base plate 610) in a first direction can, for example, exert a first force on the first portion 652 of the bushing 651 (or on a first bushing), while rotation of the hanger 630 about the kingpin 670 in a second direction can, for example, exert a second force on the second portion 653 of the bushing 651 (or on a second bushing), as described in further detail herein.

The bushing adjustment mechanism 655 can be any suitable configuration and/or can have any suitable arrangement. As shown in FIG. 32, in this embodiment, the bushing adjustment mechanism 655 is similar to or substantially the same as the bushing adjustment mechanism 555 included in the bushing assembly 550 with reference to FIGS. 27 and 28. Therefore, portion of the bushing adjustment mechanism 655 are not described in further detail herein. As such, the following description of the bushing adjustment mechanism 655 is to identify features thereof and is not intended to limit the form and/or function of the bushing adjustment mechanism 655 unless the context clearly states otherwise.

The bushing adjustment mechanism 655 includes two contact members 666 (e.g., adjustment pins) and two compression members 665. Each contact member 666 is configured to be at least partially disposed within opposite portions of the bushing 651. At least a portion of the contact members 666 can form and/or can have a threaded portion configured to form a threaded coupling with the compression members 665. As such, the contact members 666 can be configured to suspend the bushing 651 within a space defined at least in part by the sidewalls 625 and the recessed surface 616, as described in detail above. The compression members 665 are configured to engage the contact members 666 to apply a compressive force to the bushing 651. More specifically, as shown in FIG. 30, the compression members 665 are disposed within the openings 619 defined by the sidewalls 625 of the base plate 610. In some embodiments, the compression members 665 can form a threaded coupling with a surface of the sidewalls 625 defining the openings 619 and can form, at least indirectly, a threaded coupling with the contact members 666.

As described above with reference to the bushing assembly 550, in use, the compression members 665 can be moved within their associated openings 619 to move the contact members 666 relative to the bushing 651. Thus, when the compression members 665 are advanced within their associated opening 619 toward the bushing 651, the contact members 666 exert a compression force on opposite sides of the bushing 651, which in turn, increases an internal stress within the bushing 651. Conversely, when the compression members 665 are moved within their associated opening 619 away from the bushing 651, the compression force exerted on opposite sides of the bushing 651 is reduced. Thus, when the hanger 630 is rotated about the kingpin 670, deformation of the bushing 651 in response to a force exerted by the contact portion 631 on the bushing 651 is reduced, which in turn, reduces a rotational range of motion of the hanger 630 about the kingpin 670. In other instances, when the compression members 665 and the contact members 666 are moved relative to the base plate 610 to reduce the compression force exerted on the bushing 651 and the contact portion 631 exerts substantially the same force on the bushing 651, the deformation of the bushing 651 is increased, thereby increasing the rotational range of motion of the hanger 630 about the kingpin 670.

While the bushing assembly 650 is described above as including the single wedge-shaped bushing 651, in other embodiments, the bushing assembly 650 can include two or more bushings. For example, in some embodiments, the truck 600 can include a first bushing disposed on a first side of the rib 618 of the base plate 610 and a second bushing disposed on a second side of the rib 618 of the base plate 610. In this manner, when the compression member 665 disposed on the first side of the rib 618 is advanced relative to the first bushing, the contact member 666 and the rib 618 exert a compression force on the first bushing, which in turn, increases an amount of internal stress in the first bushing (as described above). Similarly, when the compression member 665 disposed on the second side of the rib 618 is advanced relative to the first bushing, the associated contact member 666 and the rib 618 exert a compression force on the second bushing, which in turn, increases an amount of internal stress in the second bushing (as described above).

While the truck 600 is described with reference to FIGS. 30-32 as including the compression members 665 that are movably coupled to the base plate 610 (e.g., via a treaded coupling or the like), in other embodiments, a bushing assembly can include a bushing adjustment mechanism at least partially coupled, for example, to a hanger. For example, FIGS. 33-36 illustrate a truck 700 according to another embodiment. In some embodiments, the truck 700 can be included in, for example, a skateboard, roller skate, and/or the like (not shown), as described above with reference to the truck 200. Therefore, in use, the truck 700 can be in a "front" position or a "rear" position of a skateboard, roller skate, etc.

As shown in FIGS. 33-36, the truck 700 includes a base plate 710, a hanger 730, a bushing assembly 750, and a kingpin 770. In some embodiments, portions of the truck 700 can be substantially similar in form and/or function as associated portions, for example, of the truck 200 described above with reference to FIGS. 2-14 and/or truck 300 described above with reference to FIGS. 15-22. Thus, such portions of the truck 700 are not described in further detail herein and should be considered substantially the same as the associated portions of the truck 200 and/or 300 unless the context clearly states otherwise.

Figure 34:
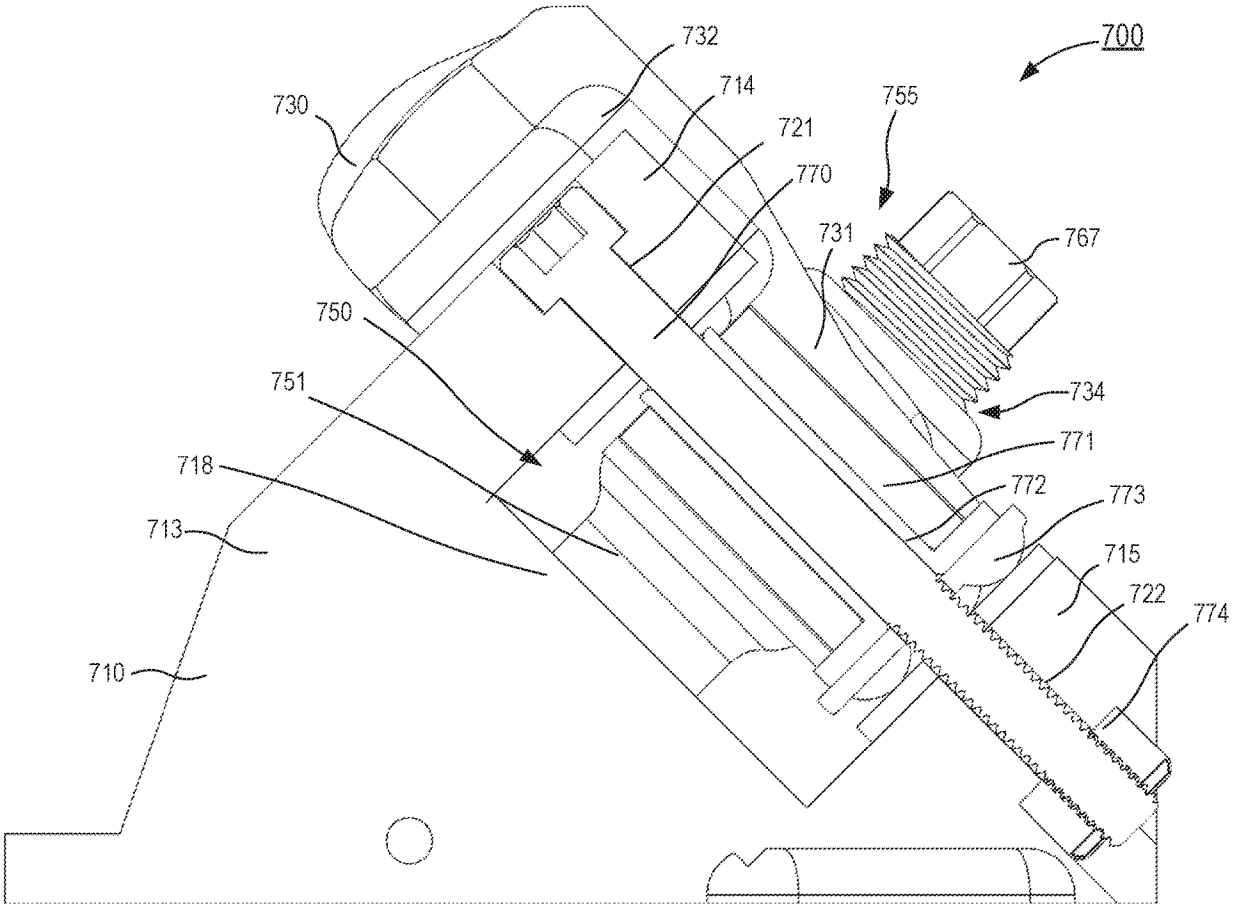
FIG. 34 is a cross-sectional view of the truck of FIG. 33 taken along the line 34-34.

In some embodiments, at least a portion of the hanger 730 of the truck 700 is substantially similar to the hanger 230 of the truck 200 described above with reference to FIGS. 7-9. Thus, the following description of the hanger 730 is to identify features thereof and is not intended to limit the form and/or function of the hanger 730 unless the context clearly states otherwise. As shown in FIG. 34, the hanger 730 defines a slot 732 and aperture 733 and includes and/or forms a contact portion 731 and a pair of axles 737. The slot 732 is configured to receive a first coupler 714 of the base plate 710 and the aperture 733 is configured to receive a portion of the kingpin 770. The axles 737 of the hanger 730 can each be independently coupled to and/or formed with the hanger 730 such that a single axle does not extend substantially through the width of the hanger 730 that might otherwise inhibit disposing the first coupler 714 in the slot 732 and the kingpin 770 in the aperture 733. The contact portion 731 is configured to be in contact with a portion of the bushing assembly 750. The contact portion 731 of the hanger 730, however, can differ from the contact portion 231 of the hanger 230, for example, by defining two openings 734 each of which are configured to receive a portion of the bushing assembly 750, as described in further detail here.

As described above with reference to the truck 200, the aperture 733 of the hanger 730 is configured to receive the kingpin 770, an inner sleeve 771, and a bearing 772 (see e.g., FIG. 34). The arrangement of the portion of the kingpin 770, the inner sleeve 771, and the bearing 772 within the aperture 733 of the hanger 730 is similar to or substantially the same as the arrangement of the kingpin 270, the inner sleeve 271, and the bearing 272 within the aperture 233 of the hanger 230 and thus, is not described in further detail herein. In addition, the truck 700 includes a damper 773 disposed between the bearing 772 and/or the hanger 730 and a second coupler 715 of the base 710, as described above with reference to the damper 273. The damper 773 of the truck 700 is substantially similar in form and function as the damper 273 of the truck 200 and thus, is not described in further detail herein.

The base plate 710 of the truck 700 can be any suitable shape, size, and/or configuration. The base plate 710 is configured to be mounted to, for example, a bottom surface of a skateboard deck or the like, as described above with reference to the base plate 210. In this embodiment, the arrangement of the base plate 710 is similar to or substantially the same as the base plate 310 of FIGS. 15-22 and thus, portions of the base plate 710 are not described in further detail herein. As such, the following description of the base plate 710 is to identify features thereof and is not intended to limit the form and/or function of the base plate 710 unless the context clearly states otherwise.

Figure 35:
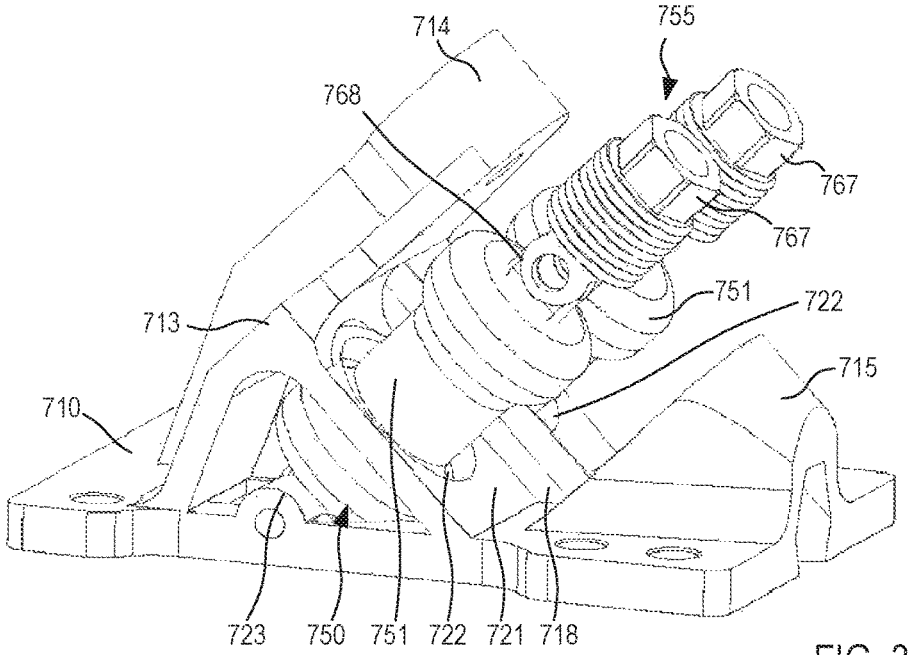
FIG. 35 is a perspective view of a portion of the truck illustrated in FIG. 33.
Figure 36:
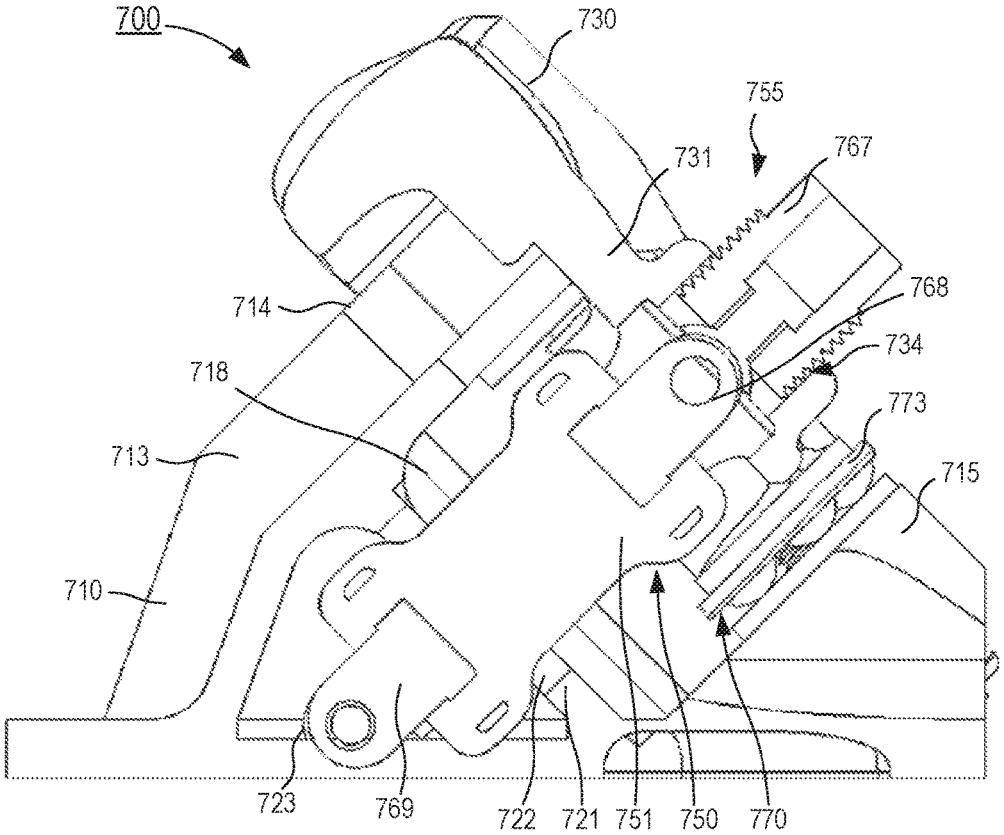
FIG. 36 is a cross-sectional view of the truck of FIG. 33 taken along the line 36-36 in FIG. 33.

As shown in FIGS. 35 and 36, the base plate 710 has a coupling portion 713 including the first coupler 714, the second coupler 715, and a recessed surface 716. The first coupler 714 and the second coupler 715 each define an opening 721 and 722, respectively, configured to receive a different portion of the kingpin 770 (see e.g., FIG. 34). The recessed surface 716 of the coupling portion 713 extends between the first coupler 714 and the second coupler 715. The recessed surface 716 includes a rib 718 and defines a set of openings 720. The rib 718 can be configured to engage a portion of the bushing assembly 750 to control a movement of at least a portion of the bushing assembly 750, as described in detail above with reference to the truck 200 in FIGS. 2-14. As shown in FIG. 35, the recessed surface 716 defines two openings 722 disposed on opposite sides of the rib 718. Each opening 722 is configured to receive a portion of the bushing assembly 750. More specifically, the base plate 710 includes an attachment portion 723 configured to couple, anchor, and/or otherwise attach the bushing assembly 750 to the base plate 710 such that a portion of the bushing assembly 750 extends through the openings 722 defined by the recessed surface 716, as described in further detail herein.

The bushing assembly 750 of the truck 700 is configured to be at least partially disposed between the base plate 710 and the hanger 730. The bushing assembly 750 can be any suitable assembly, mechanism, and/or member configured to selectively engage a portion of the base plate 710 and the hanger 730 to control movement of the hanger 730 relative to the base plate 710. As shown, for example, in FIGS. 35 and 36, in this embodiment, the bushing assembly 750 includes two bushings 751 and a bushing adjustment mechanism 755. The bushings 751 can be substantially similar in at least function to the bushings 251 included in the bushing assembly 250. Thus, portions of the bushings 751 are not described in further detail herein.

The arrangement of the bushing assembly 750 is such that a first bushing 751 is disposed on a first side of the kingpin 770 and a second bushing 751 is disposed on a second side of the kingpin 770. The bushings 751 are at least operably coupled to the base plate 710 and the hanger 730 such that rotation of the hanger 730 about the kingpin 770 (e.g., relative to the base plate 710) in a first direction can, for example, exert a first force on the first bushing 751, while rotation of the hanger 730 about the kingpin 770 in a second direction can, for example, exert a second force on the second bushing 751, as described in further detail herein.

The bushing adjustment mechanism 755 can be any suitable configuration and/or can have any suitable arrangement. As shown in FIGS. 35 and 36, in this embodiment, the bushing adjustment mechanism 755 includes a tension member 767, a first coupling member 768, and a second coupling member 769 associated with each bushing 751. The tension members 767 are configured to be movably disposed in the openings 734 defined by the hanger 730. For example, in some embodiments, the tension members 767 can form a threaded coupling with a surface of the hanger 730 defining their associated opening 734. In some embodiments, the hanger 730 and/or the bushing assembly 750 can include a threaded insert or the like configured to be disposed in the openings 734 (e.g., via a press fit, friction fit, weld, and/or the like), which in turn, forms the threaded coupling with its associated tension member 767.

Each of the first coupling members 768 is coupled to a first end portion of its associated bushing 751 and is coupled to an associated tension member 767. In other words, each first coupling member 768 forms a link between its associated bushing 751 and its associated tension member 767 to operative couple the tension member 767 to the bushing 751. Moreover, as shown in FIG. 36, the first coupling members 768 are in contact with the contact portion 731 of the hanger 730, as described in further detail herein. Each second coupling member 769 is coupled to a second end portion of its associated bushing 751 and is coupled to an associated attachment portion 723 of the base plate 710. That is to say, each second coupling member 769 forms a link between its associated bushing 751 and its associated attachment portion 723 to operative coupled the bushings 751 to the base plate 710.

As shown in FIG. 36, the bushings 751, the tension members 767, the first coupling members 768, and the second coupling members 769 form, for example, a kinematic link between the base plate 710 and the contact portion 731 of the hanger 730. This arrangement is such that movement of the tension members 767 within the openings 734 increases or decreases an amount of tension within the bushings 751. More specifically, when the tension members 767 are moved in a direction away from the bushings 751 (e.g., by advancing the tension members 767 along the threads of the hanger 730), the first coupling members 768 exert a force on the contact portion 731 of the hanger 730. With the first coupling members 768 in contact with the contact portion 731 of the hanger 730, the force exerted by the first coupling members 768 is, for example, transmitted to the bushings 751, thereby increasing a tension within the bushings 751. Conversely, when the tension members 676 are moved within the openings 734 toward the bushings 751, the force transmitted by the first coupling member 768 is reduced, which in turn, reduces the internal stress with the bushing 751 (e.g., reduces an amount of tension within the bushings 751).

In use, when the tension within the bushings 751 is increased, a deformation of the bushings 751 in response to a force associated with the rotation of the hanger 730 about the kingpin 770 is less than an amount of deformation of the bushings 751 when the bushings 751 are under less tension. In other words, the bushings 751 can be preloaded with a force (e.g., tension), which in turn, can reduce, limit, and/or control a response of the bushings 751 to a force exerted by the contact portion 731 of the hanger 730 when the hanger 730 is rotated about the kingpin 770. Thus, the tension within the bushings 751 can be increased or decreased to, for example, decrease or increase, respectively, a rotational range of motion of the hanger 730 about the kingpin 770.

While the bushings 751 are described above as being placed in tension to limit a rotational range of motion of the hanger 730 about the kingpin 770, in other embodiments, bushings can be configured to limit a rotational range of a hanger about a kingpin in any suitable manner. For example, FIGS. 37-42 illustrate a truck 800 according to another embodiment. In some embodiments, the truck 800 can be included in, for example, a skateboard, roller skate, and/or the like (not shown), as described above with reference to the truck 200. Therefore, in use, the truck 800 can be in a "front" position or a "rear" position of a skateboard, roller skate, etc.

As shown in FIGS. 37-42, the truck 800 includes a base plate 810, a hanger 830, a bushing assembly 850, and a kingpin 870. In some embodiments, portions of the truck 800 can be substantially similar in form and/or function as associated portions, for example, of the truck 200 described above with reference to FIGS. 2-14 and/or truck 700 described above with reference to FIGS. 33-36. Thus, such portions of the truck 800 are not described in further detail herein and should be considered substantially the same as the associated portions of the truck 200 and/or 700 unless the context clearly states otherwise.

Figure 37:
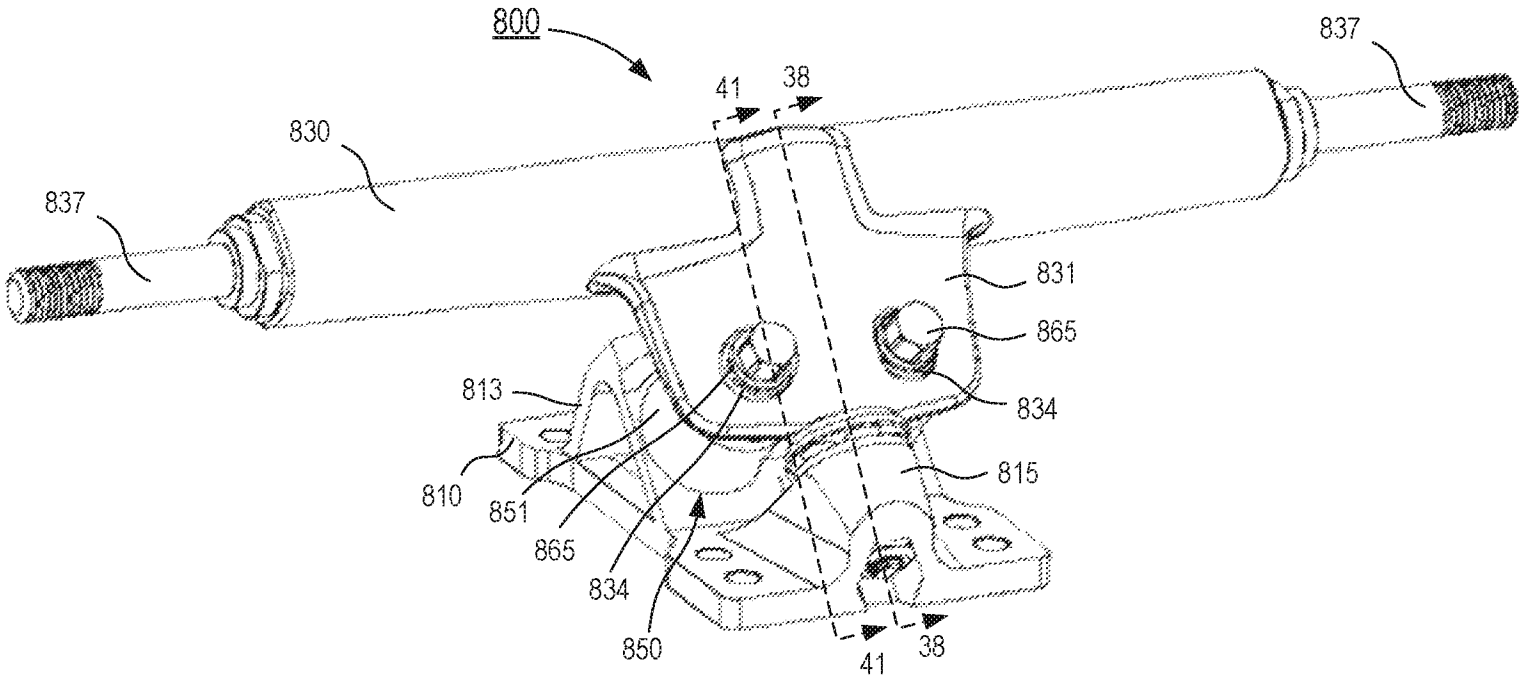
FIG. 37 is a perspective view of a truck according to another embodiment.
Figure 38:
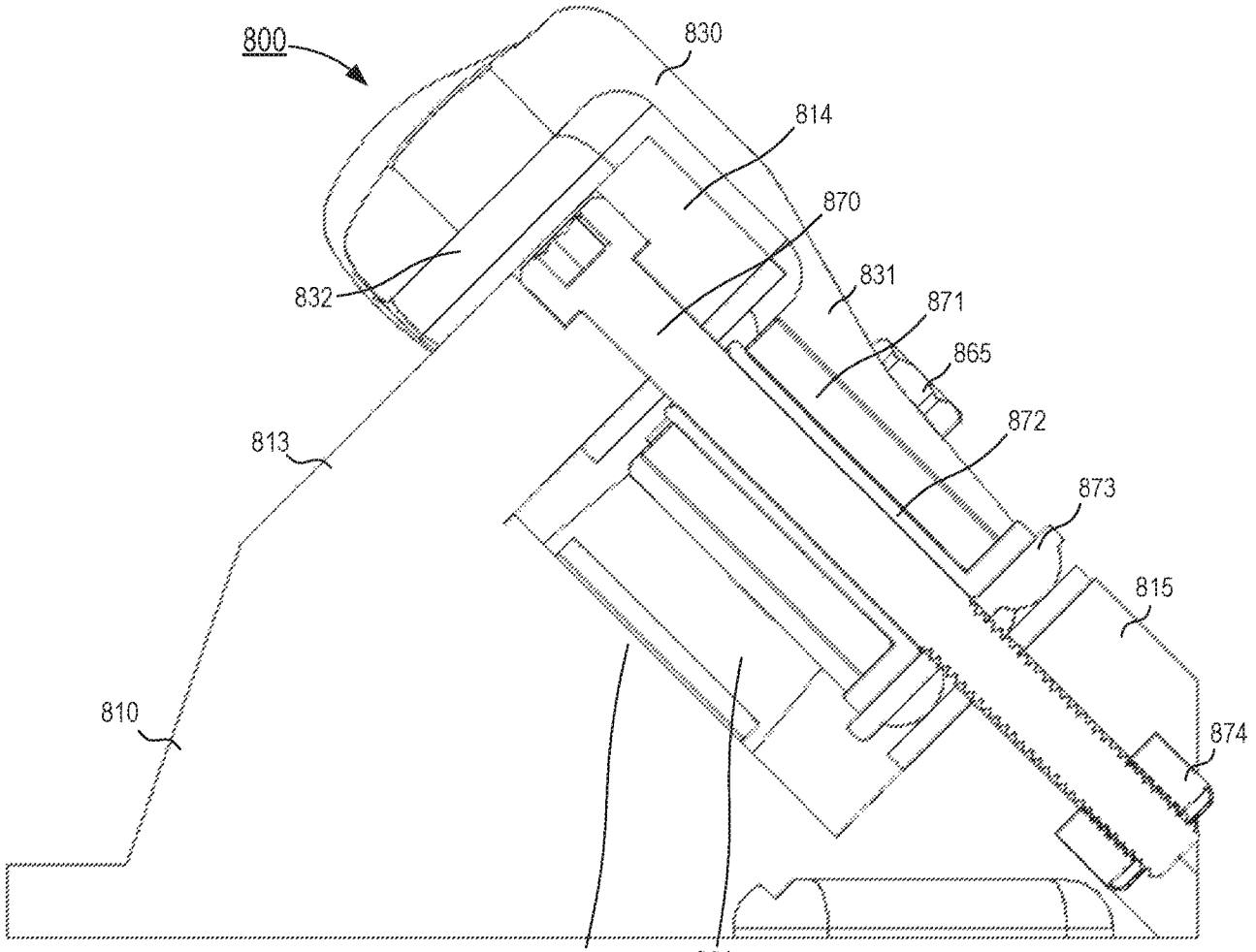
FIG. 38 is a cross-sectional view of the truck of FIG. 37 taken along the line 38-38.

The hanger 830 of the truck 800 is substantially similar to the hanger 730 of the truck 700 described above with reference to FIGS. 33-36. Thus, the following description of the hanger 830 is to identify features thereof and is not intended to limit the form and/or function of the hanger 830 unless the context clearly states otherwise. As shown in FIGS. 37 and 38, the hanger 830 defines a slot 832 and aperture 833 and includes and/or forms a contact portion 831 and a pair of axles 837. The slot 832 is configured to receive a first coupler 814 of the base plate 810 and the aperture 833 is configured to receive a portion of the kingpin 870. The axles 837 of the hanger 830 can each be independently coupled to and/or formed with the hanger 830 such that a single axle does not extend substantially through the width of the hanger 830 that might otherwise inhibit disposing the first coupler 814 in the slot 832 and the kingpin 870 in the aperture 833. The contact portion 831 is configured to be in contact with a portion of the bushing assembly 850. As described above with reference to the hanger 730, the contact portion 831 of the hanger 830 defines two openings 834 each of which are configured to receive a portion of the bushing assembly 850, as described in further detail here.

As described above with reference to the truck 200, the aperture 833 of the hanger 830 is configured to receive the kingpin 870, an inner sleeve 871, and a bearing 872 (see e.g., FIG. 38). The arrangement of the portion of the kingpin 870, the inner sleeve 871, and the bearing 872 within the aperture 833 of the hanger 830 is similar to or substantially the same as the arrangement of the kingpin 270, the inner sleeve 271, and the bearing 272 within the aperture 233 of the hanger 230 and thus, is not described in further detail herein. In addition, the truck 800 includes a damper 873 disposed between the bearing 872 and/or the hanger 830 and a second coupler 815 of the base 810, as described above with reference to the damper 273. The damper 873 of the truck 800 is substantially similar in form and function as the damper 273 of the truck 200 and thus, is not described in further detail herein.

The base plate 810 of the truck 800 can be any suitable shape, size, and/or configuration. The base plate 810 is configured to be mounted to, for example, a bottom surface of a skateboard deck or the like, as described above with reference to the base plate 210. In this embodiment, the arrangement of the base plate 810 is substantially similar in form and/or function to the base plate 210 of the truck 200 illustrated in FIGS. 2-14 and thus, portions of the base plate 810 are not described in further detail herein. As such, the following description of the base plate 810 is to identify features thereof and is not intended to limit the form and/or function of the base plate 810 unless the context clearly states otherwise.

Figure 39:
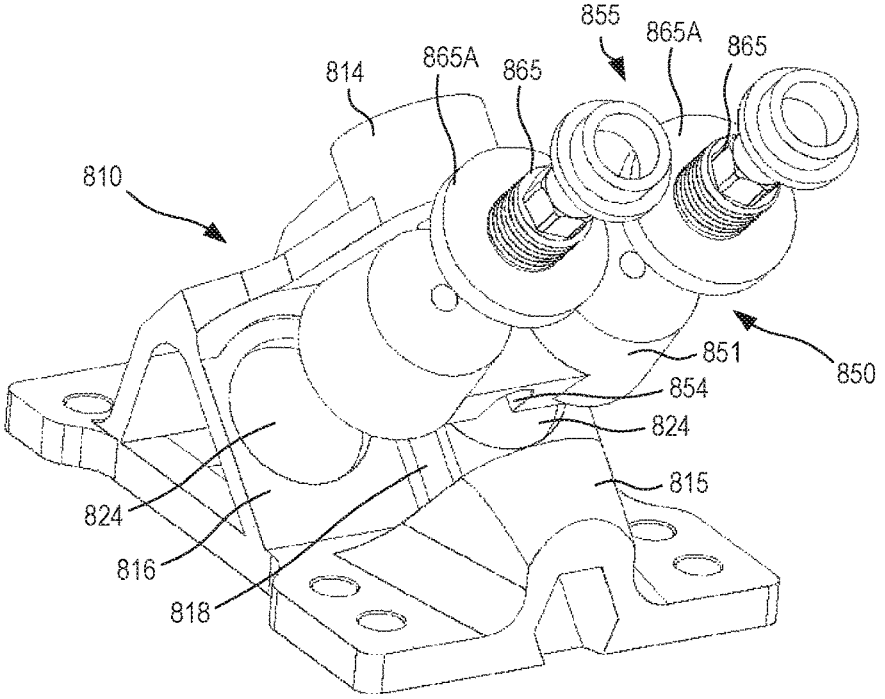
FIG. 39 is an exploded view of a portion of the truck of FIG. 37 illustrating a bushing assembly and a base plate.
Figure 40:
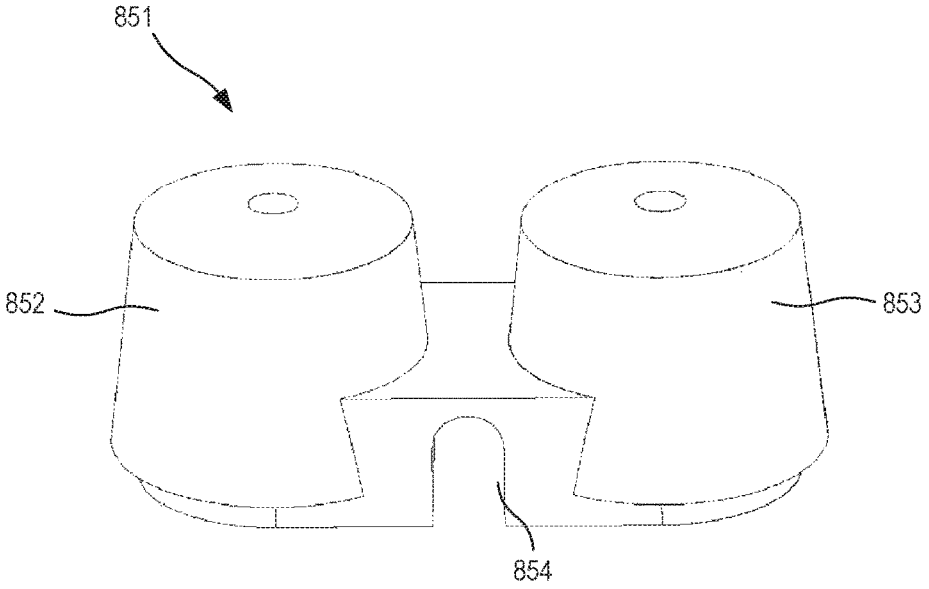
FIG. 40 is a front view of a bushing included in the bushing assembly of FIG. 39.
Figure 41:
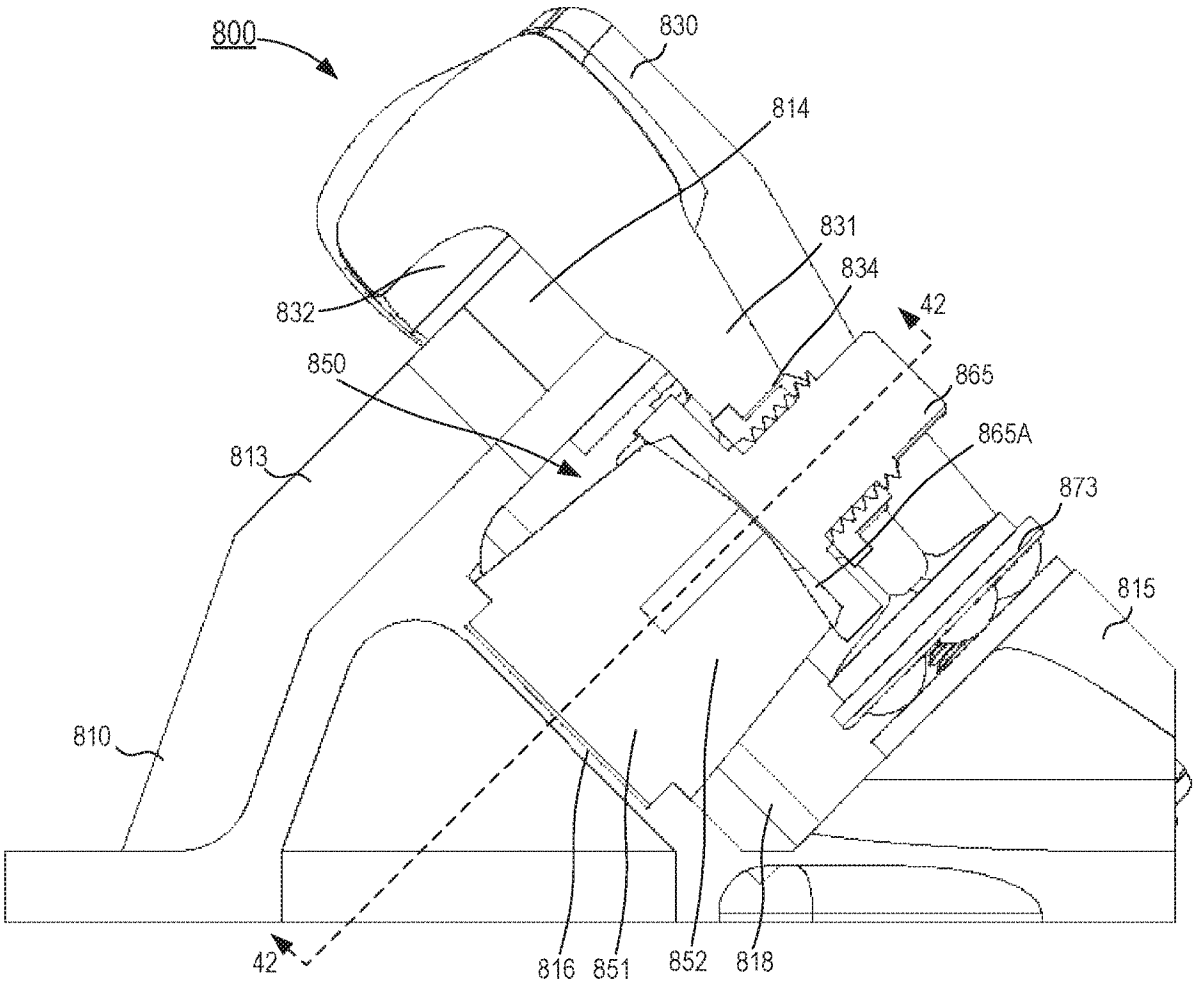
FIG. 41 is a cross-sectional view of the truck of FIG. 37 taken along the line 41-41 in FIG. 37.

As shown in FIGS. 38 and 39, the base plate 810 has a coupling portion 813 including the first coupler 814, the second coupler 815, and a recessed surface 816. The first coupler 814 and the second coupler 815 each define an opening 821 and 822, respectively, configured to receive a different portion of the kingpin 870 (see e.g., FIG. 38). The recessed surface 816 of the coupling portion 813 extends between the first coupler 814 and the second coupler 815. The recessed surface 816 includes a rib 818 and defines a set of detents 824. The rib 818 can be configured to engage a portion of the bushing assembly 850 to control a movement of at least a portion of the bushing assembly 850, as described in detail above with reference to the truck 200 in FIGS. 2-14. As shown in FIG. 39, the recessed surface 816 defines two detents 824 disposed on opposite sides of the rib 818. Each detent 824 is configured to receive a portion of the bushing assembly 850, as described in further detail herein.

The bushing assembly 850 of the truck 800 is configured to be at least partially disposed between the base plate 810 and the hanger 830. The bushing assembly 850 can be any suitable assembly, mechanism, and/or member configured to selectively engage a portion of the base plate 810 and the hanger 830 to control movement of the hanger 830 relative to the base plate 810. As shown, for example, in FIGS. 39 and 40, in this embodiment, the bushing assembly 850 includes a bushing 851 and a bushing adjustment mechanism 855. The bushing 851 can be substantially similar in at least function to the bushings 251 included in the bushing assembly 250. Thus, portions of the bushings 851 are not described in further detail herein. As shown, the bushing 851 defines a channel 854 configured to receive a portion of the rib 818. As described above with reference to the base plate 210, the rib 818 can be configured to engage a portion of the bushing 851 to control a movement (e.g., an inward movement) of at least a portion of the bushing 851.

In this embodiment, the bushing 851 includes, for example, a first portion disposed on a first side of the rib 818 and in contact with the contact portion 831 of the hanger 830, and a second portion disposed on a second side of the rib 818 and in contact with the contact portion 831 of the hanger 830. In other embodiments, the bushing assembly 850 can include two independent bushings, with a first bushing being disposed on a first side of the rib 818 and a second bushing being disposed on a second side of the rib 818 (e.g., as described above with reference to the trucks 200, 300, and 400). In this manner, rotation of the hanger 830 about the kingpin 870 (e.g., relative to the base plate 810) in a first direction can, for example, exert a first force on the first portion 852 of the bushing 851 (or on a first bushing), while rotation of the hanger 830 about the kingpin 870 in a second direction can, for example, exert a second force on the second portion 853 of the bushing 851 (or on a second bushing), as described in further detail herein.

Figure 42:
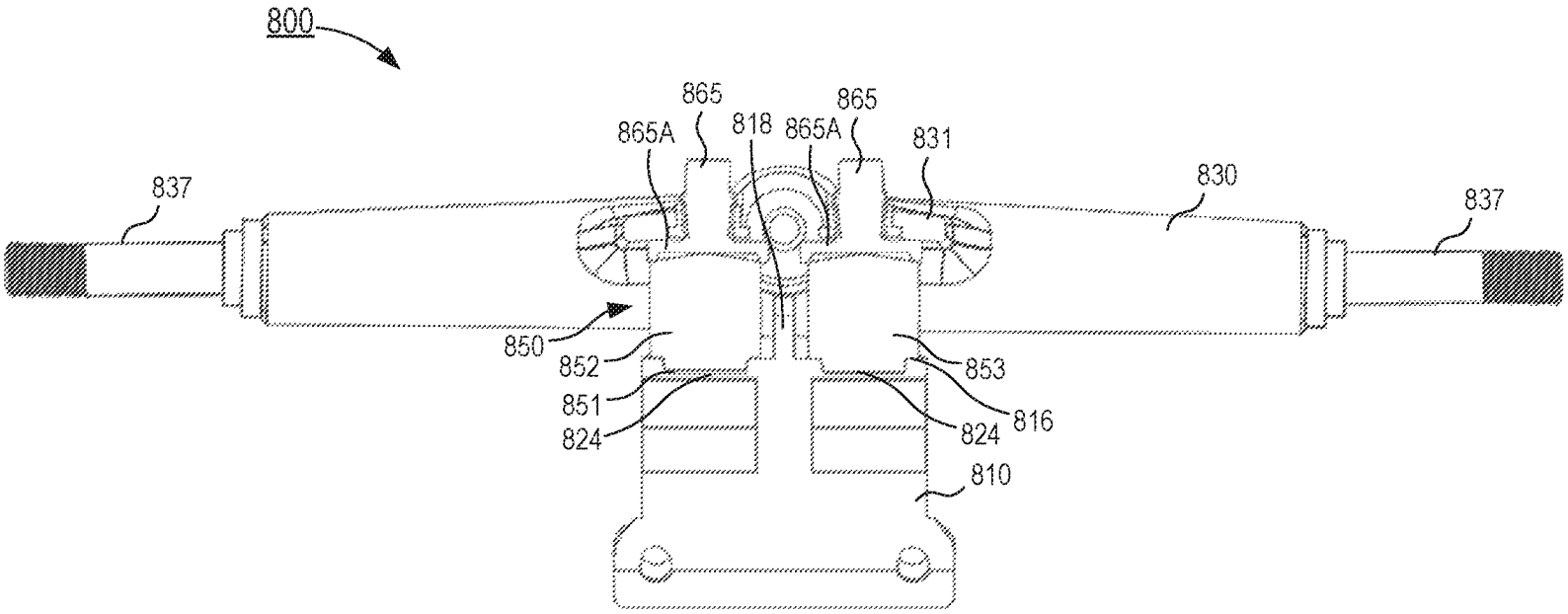
FIG. 42 is a cross-sectional view of the truck of FIG. 38 taken along the line 42-42.

The bushing adjustment mechanism 855 can be any suitable configuration and/or can have any suitable arrangement. As shown in FIG. 42, the bushing adjustment mechanism 855 includes a compression member 865 associated with each portion of the bushing 851. More specifically, the bushing adjustment mechanism 855 includes a first compression member 865 having a contact surface 865A in contact with the first portion 852 of the bushing 851 and a second compression member 865 having a contact surface 865A in contact with the second portion 853 of the bushing 851. The compression members 865 are movably disposed within the openings 834 defined by the hanger 830, as described above with reference to the tension members 767 of the bushing assembly 750 illustrated in FIGS. 33-36. For example, in some embodiments, each compression member 865 can form a threaded coupling with a surface of the hanger 830 defining its associated opening 834. In some embodiments, the hanger 830 and/or the bushing assembly 850 can include a threaded insert or the like configured to be disposed in each of the openings 834 (e.g., via a press fit, friction fit, weld, and/or the like), which in turn, forms the threaded coupling with its associated compression member 865.

The arrangement of the bushing assembly 850 is such that movement of the compression members 865 within their respective opening 834 increases or decreases an amount of compression within the first portion 852 and/or the second portion 853 of the bushing 851. For example, when the compression members 865 are moved in a direction toward the bushing 851 (e.g., by advancing the compression members 865 along the threads of the hanger 830), the contact surfaces 865A exert a force on the first portion 852 of the bushing 851 or the second portion 853 of the bushing 851, thereby increasing an amount of compression and/or internal stress within the bushings 851. Conversely, when the compression members 865 are moved within their respective opening 834 away from the bushing 851, the compression force exerted on the first portion 851 or the second portion 852 of the bushing 851 is reduced.

In use, when the compression within the bushing 851 is increased (e.g., when the internal stress within the bushing 851 is increased), a deformation of the bushing 851 in response to a force associated with the rotation of the hanger 830 about the kingpin 870 is less than an amount of deformation of the bushing 851 when the bushing 851 is under less compression. In other words, the bushing 851 can be preloaded with a force (e.g., compression), which in turn, can reduce, limit, and/or control a response of the first portion 852 and/or second portion 853 of the bushing 851 to a force exerted when the hanger 830 is rotated about the kingpin 870 (e.g., transmitted to the bushing 851 via the contact surface 865A of the compression members 865). Thus, the compression within the bushing 851 can be increased or decreased to, for example, decrease or increase, respectively, a rotational range of motion of the hanger 830 about the kingpin 870.

Figure 43:
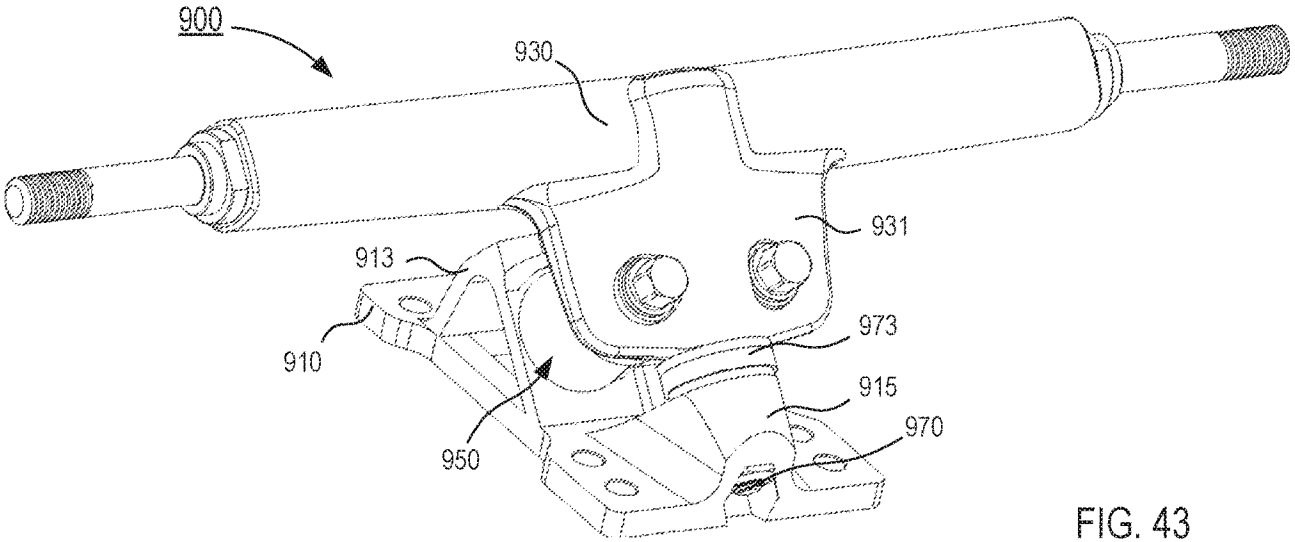
FIG. 43 is a perspective view of a truck according to another embodiment.

While the trucks 200, 300, 400, 500, 600, 700, and 800 are described above as including various bushing assemblies configured to control and/or adjust one or more characteristics associated with rotation of the respective hangers about the respective kingpins, in other embodiments, a truck can include any other suitable means of controlling or adjusting one or more characteristics associated with rotation of a hanger about a kingpin. For example, FIG. 43 illustrates a truck 900 according to another embodiment. In some embodiments, the truck 900 can be included in, for example, a skateboard, roller skate, and/or the like (not shown), as described above with reference to the truck 200. Therefore, in use, the truck 900 can be in a "front" position or a "rear" position of a skateboard, roller skate, etc.

As shown in FIG. 23, the truck 900 includes a base plate 910, a hanger 930, a bushing assembly 950, and a kingpin 970. In some embodiments, portions of the truck 900 can be substantially similar in form and/or function as associated portions of the truck 800 described above with reference to FIGS. 37-42. Thus, such portions of the truck 900 are not described in further detail herein and should be considered substantially the same as the associated portions of the truck 900 unless the context clearly states otherwise. For example, the base plate 910, the hanger 930, bushing assembly 950, and the kingpin 970 can be similar to or substantially the same as the base plate 810, the hanger 830, bushing assembly 850, and the kingpin 870, respectively, described above with reference to FIGS. 37-42. Thus, the base plate 910, the hanger 930, bushing assembly 950, and the kingpin 970 are not described in further detail herein.

The truck 900, however, can differ from the truck 800 in the arrangement and/or configuration of a damper 973 disposed about the kingpin 970 between a contact portion 931 of the hanger 930 and a second coupler 915 of the base plate 910. As shown in FIG. 43, in this embodiment, the damper 973 has a greater thickness than the damper 873 included in the truck 800. As such, the damper 973 can be configured to increase a friction force between the contact portion 931 of the hanger 930 and the second coupler 915 of the base plate 910. For example, the base plate 910 is configured to define a predetermined distance between a first coupler (not shown in FIG. 43) and the second coupler 915. When the hanger 930 and the damper 973 are disposed about the kingpin 970 and the kingpin 970 is coupled to the base plate 910, the hanger 930 and the damper 973 collectively define a length that is substantially equal to the predetermined distance. Thus, an increase in thickness of the damper 973 increases the collective length of the hanger 930 and the damper 973, which in turn, results in a compressive force being exerted by the contact portion 931 of the hanger 930 and the second coupler 915 of the base plate 910. In this manner, the increase in the thickness of the damper 973 increases the compressive force exerted by the contact portion 931 and the second coupler 915, which increases a friction force therebetween. The increase in the friction force, in turn, can be operative in limiting, slowing, restricting, and/or otherwise controlling, for example, one or more characteristics associated with a rotation of the hanger 930 about the kingpin 970. Thus, in some instances, the arrangement of the bushing assembly 950 and the arrangement of the damper 973 can collectively act to control one or more characteristics associated with the rotation of the hanger 930 about the kingpin 970.

Figure 44:
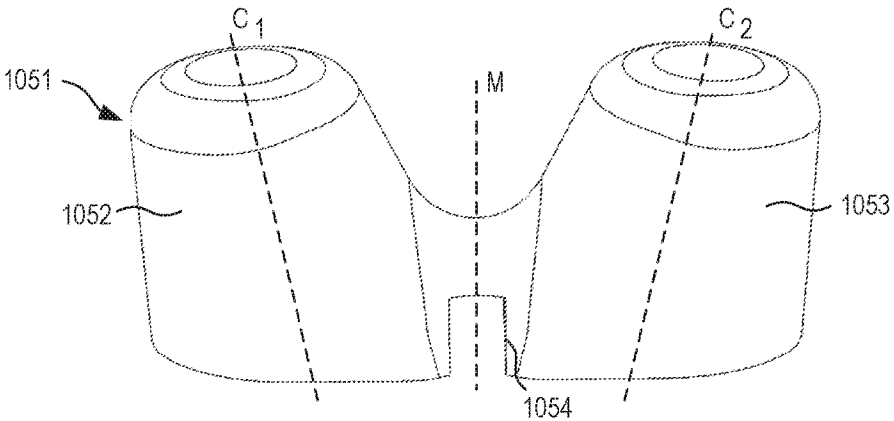
FIG. 44 is a front view of a bushing according to an embodiment.

While the bushing 851 of the truck 800 is particularly shown and described above with reference to FIGS. 37-42, in other embodiments, a bushing can be any suitable shape, size, and/or configuration. For example, FIG. 44 illustrates a bushing 1051 according to an embodiment. The bushing 1051 can be included in any suitable truck described herein. For example, in some embodiments, the bushing 1051 can be included in the bushing assembly 850 of the truck 800 described above with reference to FIGS. 37-42. The bushing 1051 includes a first portion 1052 and a second portion 1053 and defines a channel 1054. The channel 1054 can receive a portion of a rib when the bushing 1051 is coupled to a base plate, as described above with reference to the bushing 851. Moreover, the first portion 1052 and the second portion 1053 of the bushing 1051 can be configured to be in contact with a contact portion of a hanger and/or a contact surface of a compression member (movably coupled to the hanger), as described above with reference to the truck 800.

As shown in FIG. 44, the arrangement of the bushing 1051 is such that a centerline $C_1$ of the first portion 1052 and a centerline $C_2$ of the second portion 1053 are oriented, arranged, and/or otherwise disposed at a substantially non-perpendicular angle relative to a midplane M of the bushing 1051. In some embodiments, such an arrangement of the first portion 1052 and the second portion 1053, for example, can be associated with and/or substantially aligned with a direction of a force exerted on the first portion 1052 and/or the second portion 1053 associated with rotation of the hanger about the kingpin (described in detail above). For example, when the hanger (such as those described above) is rotated about the kingpin, the force exerted by the contact portion of the hanger has a tangential component that is non-perpendicular to the axis of rotation of the hanger (in at least one plane). Thus, the force can be exerted substantially along the centerlines $C_1$ and/or $C_2$ of the first portion 1052 and/or the second portion 1053, respectively, which in some instances, can result in deformation of the first portion 1052 and/or the second portion 1053 along the centerlines $C_1$ and $C_2$, respectively. In some embodiments, such an arrangement can, for example, reduce a likelihood of undesirable sheer forces, an increase in a direct reaction force in response to the rotation of the hanger, an increase in the predictability and/or reliability of a desired response to the rotation of the hanger, and/or the like.

While various embodiments have been described above, it should be understood that they have been presented by way of example only, and not limitation. While the embodiments have been particularly shown and described, it will be understood that various changes in form and details may be made. For example, while the embodiments described herein include bushing assemblies having either one or two bushings, in other embodiments, any of the embodiments described herein can include a single bushing. In other embodiments, any of the embodiments, can have two or more independent bushings. While some of the embodiments described herein include a hanger with a substantially planar contact portion configured to contact one or more bushings, in other embodiments, a contact portion of a hanger can be substantially concave, substantially convex, and/or otherwise substantially non-planar.

Where schematics and/or embodiments described above indicate certain components arranged in certain orientations or positions, the arrangement of components may be modified. Although various embodiments have been described as having particular features and/or combinations of components, other embodiments are possible having a combination of any features and/or components from any of embodiments as discussed above. For example, in some embodiments, the bushing assembly 850 of the truck 800 described above with reference to FIGS. 33-36 can include a bushing similar to or substantially the same as the bushing 1051 described above with reference to FIG. 43.

Where methods and/or events described above indicate certain events and/or procedures occurring in certain order, the ordering of certain events and/or procedures may be modified. Additionally, certain events and/or procedures may be performed concurrently in a parallel process when possible, as well as performed sequentially as described above.

What is claimed:

1. An apparatus, comprising:

a base plate having a contact surface and a coupling portion, the contact surface configured to be placed in contact with a skateboard deck;

a hanger rotatably coupled to the coupling portion of the base plate;

a kingpin disposed within a portion of the hanger to couple the hanger to the base plate for rotation about the kingpin; and a bushing assembly disposed between the base plate and the hanger and isolated from the kingpin, the bushing assembly having a bushing with a first bushing portion in contact with at least one of the hanger or the base plate on a first side of the kingpin and a second bushing portion in contact with at least one of the hanger or the base plate on a second side of the kingpin opposite the first side, the bushing assembly having a bushing adjustment with a first bushing adjustment portion coupled to the hanger on the first side of the kingpin and a second bushing adjustment portion coupled to the hanger on the second side of the kingpin, the first bushing adjustment portion configured to selectively engage the first bushing portion and the second bushing adjustment portion configured to selectively engage the second bushing portion to transition the bushing assembly between a first configuration in which the bushing exerts a first force in response to rotation of the hanger about the kingpin and a second configuration in which the bushing exerts a second force different from the first force in response to rotation of the hanger about the kingpin.

2. The apparatus of claim 1, wherein the bushing adjustment is configured to be adjusted to transition the bushing assembly between a first configuration and a second configuration, and wherein adjusting the bushing adjustment adjusts an internal stress within at least one of the first bushing portion or the second bushing portion.

3. The apparatus of claim 1, wherein the first bushing adjustment portion and the second bushing adjustment portion are each immovably coupled to the hanger.

4. The apparatus of claim 1, wherein the bushing adjustment is configured to transition the bushing assembly from the first configuration to the second configuration in response to at least one of (1) the first bushing adjustment portion moving the first bushing portion between a first position relative to the hanger and a second position relative to the hanger or (2) the second bushing adjustment portion moving the second bushing portion between a first position relative to the hanger and a second position relative to the hanger.

5. The apparatus of claim 1, wherein a portion of the bushing adjustment is configured to move linearly to transition the bushing assembly between the first configuration and the second configuration.

6. The apparatus of claim 1, wherein a portion of the bushing adjustment is configured to rotate to transition the bushing assembly between the first configuration and the second configuration.

7. The apparatus of claim 1, wherein the first bushing adjustment portion is in contact with the first bushing portion and is configured to move the first bushing portion between a first position and a second position relative to the hanger on the first side of the kingpin, the second bushing adjustment portion is in contact with the second bushing portion and is configured to move the second bushing portion between a first position and a second position relative to the hanger on the second side of the kingpin.

8. The apparatus of claim 1, wherein the first bushing adjustment portion is configured to rotate relative to the hanger to move first bushing portion from a first linear position relative to the hanger to a second linear position relative to the hanger on the first side of the kingpin, the second bushing adjustment portion is configured to rotate relative to the hanger to move the second bushing portion from a first linear position relative to the hanger to a second linear position relative to the hanger on the second side of the kingpin.

9. An apparatus, comprising:

a base plate having a contact surface and a coupling portion, the contact surface configured to be placed in contact with a skateboard deck, the coupling portion including a first coupler and a second coupler;

a hanger rotatably coupled to the coupling portion of the base plate and configured to rotate about an axis collectively defined by the first coupler and the second coupler, the hanger having a contact portion disposed between the first coupler and the second coupler of the base plate;

a kingpin coupled to the first coupler and the second coupler of the base plate and aligned with the axis, a portion of the kingpin disposed within an aperture defined by the contact portion of the hanger such that the hanger is rotatable about the axis; and a bushing assembly independent of the kingpin and disposed between the base plate and the hanger, the bushing assembly having at least one bushing in contact with at least one of the contact portion of the hanger or the coupling portion of the base plate, the bushing assembly having a bushing adjustment configured to transition the bushing assembly between a first configuration in which the at least one bushing exerts a first force in response to rotation of the hanger about the axis and a second configuration in which the at least one bushing exerts a second force different from the first force in response to rotation of the hanger about the axis.

10. The apparatus of claim 9, further comprising:

a bearing disposed between an inner surface of the hanger defining the aperture and an outer surface of the kingpin, the bearing facilitating rotation of the hanger about the kingpin.

11. The apparatus of claim 9, wherein rotation of the hanger is limited to rotation about the axis.

12. The apparatus of claim 9, wherein the bushing adjustment is configured to transition the bushing assembly between the first configuration and the second configuration independent of the kingpin rotatably coupling the hanger to the base plate.

13. The apparatus of claim 9, wherein the at least one bushing is in contact with the coupling portion of the base plate, the bushing adjustment is movably coupled to the contact portion of the hanger and in contact with the at least one bushing such that the at least one bushing is separated from the contact portion of the hanger.

14. The apparatus of claim 13, wherein adjusting the bushing adjustment adjusts an amount of separation between the contact portion of the hanger and the at least one bushing.

15. The apparatus of claim 9, wherein the at least one bushing is a single bushing in contact with the contact surface of the base plate, the bushing includes a first bushing portion disposed on a first side of the kingpin and a second bushing portion disposed on a second side of the kingpin, the bushing adjustment includes a first bushing adjustment portion movably coupled to the contact portion of the hanger and in contact with the first bushing portion such that the first bushing portion is isolated from the contact portion of the hanger, the bushing adjustment includes a second bushing adjustment portion movably coupled to the contact portion of the hanger and in contact with the second bushing portion such that the second bushing portion is isolated from the contact portion of the hanger.

16. An apparatus, comprising:

a base plate having a contact surface and a coupling portion, the contact surface configured to be placed in contact with a skateboard deck;

a hanger rotatably coupled to the coupling portion of the base plate, the hanger having a contact portion;

a kingpin rotatably coupling the contact portion of the hanger to the coupling portion of the base plate such that the hanger is rotatable relative to the coupling portion of the base plate and about the kingpin; and a bushing assembly independent of the kingpin and disposed between the base plate and the hanger, the bushing assembly having a bushing in contact with the base plate, the bushing having a first portion disposed on a first side of the kingpin and a second portion disposed on a second side of the kingpin opposite the first side, the bushing assembly having a first bushing adjustment movably coupled to the contact portion of the hanger on the first side of the kingpin and in contact with the first portion of the bushing, and a second bushing adjustment movably coupled to the contact portion of the hanger on the second side of the kingpin and in contact with the second portion of the bushing, the first bushing adjustment and the second bushing adjustment configured to be adjusted to transition the bushing assembly between a first configuration in which the bushing exerts a first force in response to rotation of the hanger and a second configuration in which the bushing exerts a second force different from the first force in response to rotation of the hanger, wherein adjusting the first bushing adjustment moves a portion of the first bushing adjustment relative to the contact portion of the hanger between a first position, closer to the contact portion, and a second position, further from the contact portion, wherein adjusting the second bushing adjustment moves a portion of the second bushing adjustment relative to the contact portion of the hanger between a first position, closer to the contact portion, and a second position, further from the contact portion.

17. The apparatus of claim 16, wherein the hanger includes a first axle and a second axle, the hanger defines a slot disposed between the first axle and the second axle, a portion of the coupling portion of the base plate is disposed within the slot.

18. The apparatus of claim 16, wherein a portion of the first bushing adjustment is disposed between the first portion of the bushing and the contact portion of the hanger, and a portion of the second bushing adjustment is disposed between the second portion of the bushing and the contact portion of the hanger.

19. The apparatus of claim 18, wherein adjusting the first bushing adjustment and the second bushing adjustment adjusts an amount of separation between the contact portion of the hanger and the first portion of the bushing and the second portion of the bushing, respectively.

* * * * *